US011798483B1

(12) United States Patent
Ha et al.

(10) Patent No.: US 11,798,483 B1
(45) Date of Patent: Oct. 24, 2023

(54) DISPLAY APPARATUS

(71) Applicant: Samsung Display Co., Ltd., Yongin-si (KR)

(72) Inventors: Taeseok Ha, Yongin-si (KR); Woonrok Jang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 18/084,701

(22) Filed: Dec. 20, 2022

(30) Foreign Application Priority Data

May 20, 2022 (KR) ..... 10-2022-0062309

(51) Int. Cl.
*G09G 3/3258* (2016.01)

(52) U.S. Cl.
CPC ... *G09G 3/3258* (2013.01); *G09G 2300/0426* (2013.01); *G09G 2300/0439* (2013.01); *G09G 2310/0264* (2013.01); *G09G 2320/02* (2013.01); *G09G 2330/021* (2013.01)

(58) Field of Classification Search
CPC ... G09G 3/3258; G09G 3/3291; G09G 3/3233
See application file for complete search history.

(56) References Cited

U.S. PATENT DOCUMENTS

| | | | | |
|---|---|---|---|---|
| 9,482,764 | B1 | 11/2016 | Shahar et al. | |
| 10,943,515 | B2 | 3/2021 | Kim et al. | |
| 2003/0103022 | A1 | 6/2003 | Noguchi et al. | |
| 2022/0051638 | A1* | 2/2022 | Huang | G09G 3/3614 |
| 2022/0335885 | A1* | 10/2022 | Wu | G09G 3/32 |

FOREIGN PATENT DOCUMENTS

| | | |
|---|---|---|
| KR | 10-0570995 | 4/2006 |
| KR | 10-2019-0103540 | 9/2019 |

* cited by examiner

*Primary Examiner* — Sardis F Azongha
(74) *Attorney, Agent, or Firm* — KILE PARK REED & HOUTTEMAN PLLC

(57) ABSTRACT

A display apparatus includes a first pixel positioned in a first pixel row and including a first light-emitting diode and a first initialization transistor connected between a pixel electrode of the first light-emitting diode and an initialization line, a second pixel positioned in a second pixel row and including a second light-emitting diode and a second initialization transistor connected between a pixel electrode of the second light-emitting diode and the initialization line, and a charge sharing circuit including a control transistor connected between the pixel electrode of the first light-emitting diode and the pixel electrode of the second light-emitting diode.

20 Claims, 21 Drawing Sheets

DISPLAY APPARATUS

CROSS-REFERENCE TO RELATED APPLICATION(S)

This application claims priority to and benefits of Korean Patent Application No. 10-2022-0062309 under 35 U.S.C. § 119, filed on May 20, 2022, in the Korean intellectual Property Office (KIPO), the entire contents of which is incorporated herein by reference.

BACKGROUND

1. Technical Field

One or more embodiments relate to a display apparatus and an operating method of the display apparatus.

2. Description of the Related Art

In general, an organic light-emitting display apparatus includes pixels each including an organic light-emitting diode and a thin-film transistor. The organic light-emitting diode of each pixel may emit light with a luminance, which is controlled by driving current.

SUMMARY

One or more embodiments include a display apparatus capable of reducing power consumption and improving image quality by charging a pixel electrode by sharing charges between pixels positioned in different pixel rows. However, the embodiments are examples, and do not limit the scope of the disclosure.

Additional aspects will be set forth in part in the description which follows and, in part, will be apparent from the description, or may be learned by practice of the embodiments.

According to one or more embodiments, a display apparatus may include a first pixel positioned in a first pixel row and including a first light-emitting diode and a first initialization transistor connected between a pixel electrode of the first light-emitting diode and an initialization line, a second pixel positioned in a second pixel row and including a second light-emitting diode and a second initialization transistor connected between a pixel electrode of the second light-emitting diode and the initialization line, a charge sharing circuit including a control transistor connected between the pixel electrode of the first light-emitting diode and the pixel electrode of the second light-emitting diode, a first gate line positioned in the first pixel row and connected to a gate of the first initialization transistor, a second gate line positioned in the second pixel row and connected to a gate of the second initialization transistor, and a control line connected to a gate of the control transistor.

The charge sharing circuit may further include a control diode connected between the control transistor and the pixel electrode of the first light-emitting diode.

A control signal applied to the control line may be applied later than a gate signal applied to the first gate line and earlier than a gate signal applied to the second gate line, wherein a pixel electrode voltage of the first light-emitting diode may include from an initialization voltage applied from the initialization line to a first intermediate voltage at a first slew rate during a first period for which the control signal is applied, and may include from the first intermediate voltage to a light-emitting voltage at a second slew rate during a second period subsequent to the first period.

A control signal applied to the control line may be applied later than a gate signal applied to the first gate line and earlier than a gate signal applied to the second gate line, wherein a pixel electrode voltage of the second light-emitting diode may decrease from a light-emitting voltage to a second intermediate voltage at a third slew rate during a period of a period for which the control signal is applied, and may decrease from the second intermediate voltage to an initialization voltage applied from the initialization line at a fourth slew rate during a period of a period for which the gate signal is applied to the second gate line.

The second pixel row may be spaced apart from the first pixel row by two pixel rows, wherein a gate signal applied to the second gate line may be applied later than a gate signal applied to the first gate line by a certain time, and a control signal applied to the control line is positioned between the gate signal applied to the first gate line and the gate signal applied to the second gate line.

The control signal may be applied later than the gate signal applied to the first gate line by a certain time.

The display apparatus may further include a third pixel positioned in a third pixel row between the first pixel row and the second pixel row and including a third light-emitting diode and a third initialization transistor connected between a pixel electrode of the third light-emitting diode and the initialization line, wherein the third pixel row may be spaced apart from each of the first pixel row and the second pixel row by one pixel row, wherein the control line may be a third gate line connected to a gate of the third initialization transistor.

The second pixel row may be spaced apart from the first pixel row by three pixel rows, wherein a gate signal applied to the second gate line may be applied later than a gate signal applied to the first gate line by a certain time, and a control signal applied to the control line may be positioned between the gate signal applied to the first gate line and the gate signal applied to the second gate line.

The control signal may be applied later than the gate signal applied to the first gate line by a certain time.

The display apparatus may further include a third pixel positioned in a third pixel row between the first pixel row and the second pixel row and including a third light-emitting diode and a third initialization transistor connected between a pixel electrode of the third light-emitting diode and the initialization line, wherein the third pixel row may be spaced apart from the first pixel row by two pixel rows, and may be spaced apart from the second pixel row by one pixel row, wherein the control line may be a third gate line connected to a gate of the third initialization transistor.

A gate signal applied to the third gate line may be subsequent to a gate signal applied to the first gate line, and may partially overlap a gate signal applied to the second gate line.

According to one or more embodiments, a display apparatus may include a pixel unit including a plurality of pixels, and a gate driver that applies a gate signal to the plurality of pixels, wherein the pixel unit includes a first pixel positioned in a first pixel row, and including a first light-emitting diode, and a first initialization transistor, the first initialization transistor being connected between a pixel electrode of the first light-emitting diode and an initialization line and controlled by a first gate signal, a second pixel positioned in a second pixel row, and including a second light-emitting diode and a second initialization transistor, the second initialization transistor being connected between a pixel electrode of the second light-emitting diode and the initialization line and controlled by a second gate signal that is applied later than the first gate signal by a certain time, and a charge sharing circuit including a control transistor connected between the pixel electrode of the first light-emitting diode and the pixel electrode of the second light-emitting diode, and controlled by a control signal applied between the first gate signal and the second gate signal.

The charge sharing circuit may further include a control diode forward-biased from the pixel electrode of the second light-emitting diode to the pixel electrode of the first light-emitting diode.

A pixel electrode voltage of the first light-emitting diode may increase from an initialization voltage applied from the initialization line to a first intermediate voltage at a first slew rate during a first period of a period for which the control signal is applied, and may increase from the first intermediate voltage to a light-emitting voltage at a second slew rate during a second period subsequent to the first period.

A pixel electrode voltage of the second light-emitting diode may decrease from a light-emitting voltage to a second intermediate voltage at a third slew rate during a period of a period for which the control signal is applied, and may decrease from the second intermediate voltage to an initialization voltage applied from the initialization line during a period of a period for which a gate signal is applied to a gate of the second initialization transistor.

The control signal may be applied later than the first gate signal by a certain time.

The pixel unit may further include a third pixel positioned in a third pixel row, and including a third light-emitting diode and a third initialization transistor, the third initialization transistor being connected between a pixel electrode of the third light-emitting diode and the initialization line, wherein the second pixel row is spaced apart from the first pixel row by two pixel rows, and the third pixel row may be spaced apart from each of the first pixel row and the second pixel row by one pixel row, wherein the control signal may be a gate signal applied to a gate line connected to a gate of the third initialization transistor.

The pixel unit may further include a third pixel positioned in a third pixel row, and including a third light-emitting diode and a third initialization transistor, the third initialization transistor being connected between a pixel electrode of the third light-emitting diode and the initialization line, wherein the second pixel row may be spaced apart from the first pixel row by three pixel rows, and the third pixel row may be spaced apart from the first pixel row by two pixel rows, and may be spaced apart from the second pixel row by one pixel row, wherein the control signal may be a third gate signal applied to a gate line connected to a gate of the third initialization transistor.

The third gate signal may be subsequent to the first gate signal, and may partially overlap the second gate signal.

The gate driver may include a first gate driver positioned on a left side of the pixel unit, and a second gate driver positioned on a right side of the pixel unit, wherein the first pixel row and the second pixel row may be an odd row and an even row spaced apart from each other by three pixel rows.

BRIEF DESCRIPTION OF THE DRAWINGS

The above and other aspects, features, and advantages of certain embodiments will be more apparent from the following description taken in conjunction with the accompanying drawings, in which.

DETAILED DESCRIPTION OF THE EMBODIMENTS

Figure 1:
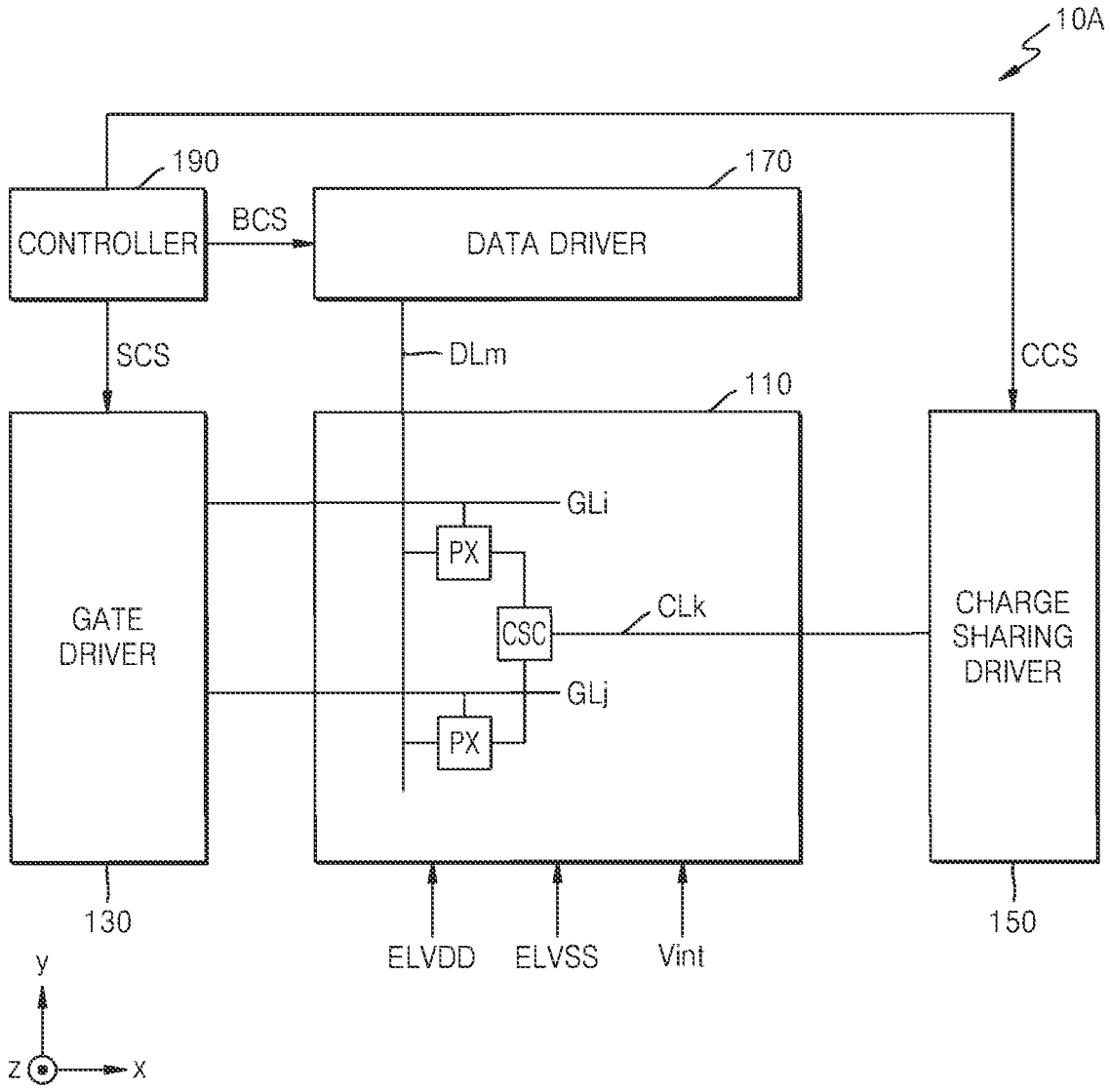
FIGS. 1 and 2 are schematic diagrams illustrating a display apparatus according to an embodiment.

Reference will now be made in detail to embodiments, examples of which are illustrated in the accompanying drawings, wherein like reference numerals refer to like elements throughout. In this regard, the embodiments may have different forms and should not be construed as being limited to the descriptions set forth herein. Accordingly, the embodiments are described below, by referring to the figures, to explain aspects of the description. As used herein, the term "and/or" includes any and all combinations of one or more of the associated listed items. Throughout the disclosure, the expression "at least one of a, b or c" indicates only a, only b, only c, both a and b, both a and c, both b and c, all of a, b, and c, or variations thereof.

As the disclosure allows for various changes and numerous embodiments, certain embodiments will be illustrated in the drawings and described in the detailed description. Effects and features of the disclosure, and methods for achieving them will be clarified with reference to embodiments described below in detail with reference to the drawings. However, the disclosure is not limited to the following embodiments and may be embodied in various forms.

Although the terms "first," "second," etc. may be used to describe various elements, these elements should not be limited by these terms. These terms are only used to distinguish one element from another.

As used herein, the singular forms "a," "an," and "the" are intended to include the plural forms as well, unless the context clearly indicates otherwise.

It will be understood that the terms "including," "having," and "including" are intended to indicate the existence of the features or elements described in the specification, and are not intended to preclude the possibility that one or more other features or elements may exist or may be added.

It will be further understood that, in case that a layer, region, or element is referred to as being "on" another layer, region, or element, it may be directly on the other layer, region, or element, or may be indirectly on the other layer, region, or element with intervening layers, regions, or elements therebetween.

Sizes of elements in the drawings may be exaggerated or contracted for convenience of explanation. For example, because sizes and thicknesses of elements in the drawings are arbitrarily illustrated for convenience of explanation, Embodiments are not limited thereto.

"A and/or B" is used herein to select only A, select only B, or select both A and B. Also, "at least one of A and B" is used herein to select only A, select only B, or select both A and B.

For example, in this specification and the like, an explicit description "X and Y are connected" means that X and Y are electrically connected, X and Y are functionally connected, and X and Y are directly connected. Here, X and Y may each denote an object (e.g., a device, an element, a circuit, a line, an electrode, a terminal, a conductive film, a layer, or the like). Accordingly, a connection relationship is not limited to a certain connection relationship, for example, a connection relationship shown in the drawings or the detailed description, and may include anything other than the connection relationship shown in the drawings or the detailed description.

For example, in case that X and Y are electrically connected, one or more elements that enable electrical connection between X and Y (e.g., a switch, a transistor, a capacitor, an inductor, a resistor, or a diode) may be connected between X and Y.

In the following embodiments, "on" used in association with a device state may refer to a state in which a device is activated (or turned on), and "off" may refer to a state in which a device is deactivated (turned off). "on" used in association with a signal received by a device may refer to a signal for activating a device, and "off" may refer to a signal for deactivating a device. A device may be activated by a high-level voltage or a low-level voltage. For example, a P-type transistor is activated by a low-level voltage and an N-type transistor is activated by a high-level voltage. Accordingly, it should be understood that "on" voltages for the P-type transistor and the N-type transistor have opposite (high and low) voltage levels. A voltage level of a voltage for activating (turning on) a transistor is referred to as an on-voltage level, and a voltage level of a voltage for deactivating (turning off) a transistor is referred to as an off-voltage level.

Figure 2:
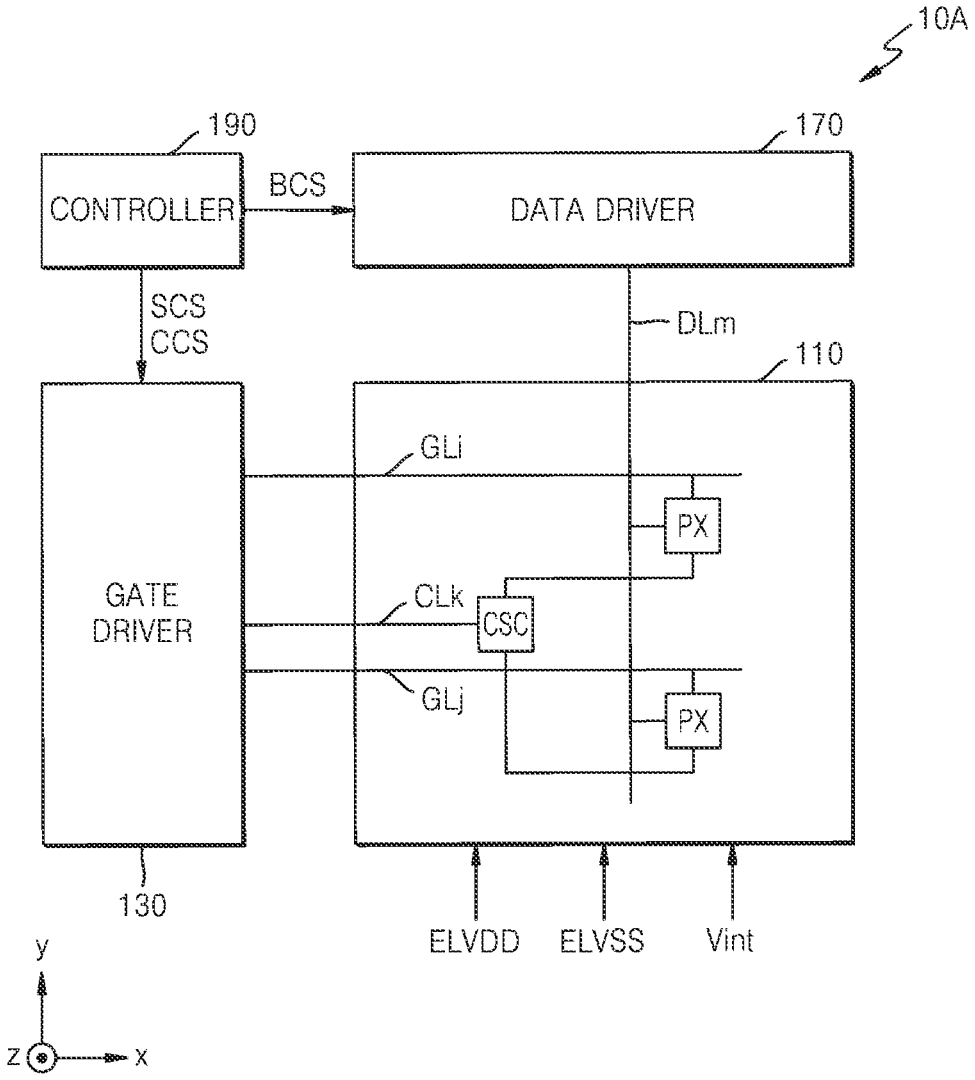

FIGS. 1 and 2 are schematic diagrams illustrating a display apparatus according to an embodiment.

Referring to FIG. 1, a display apparatus 10A according to an embodiment may include a pixel unit 110, a gate driver 130, a charge sharing driver 150, a data driver 170, and a controller 190.

Pixels PX and signal lines for applying an electrical signal to the pixels PX may be positioned in the pixel unit 110.

The pixels PX may be repeatedly arranged in a first direction (e.g., an x-axis direction or a row direction) and a second direction (e.g., a y-axis direction or a column direction). The pixels PX may be positioned in any of various arrangements such as a stripe arrangement, a PENTILE® arrangement, or a mosaic arrangement, to display an image. Each of the pixels PX may include an organic light-emitting diode as a display element, and the organic light-emitting diode may be connected to a pixel circuit. The pixel circuit may include transistors and at least one capacitor.

In an embodiment, the transistors included in the pixel circuit may be N-type oxide thin-film transistors. For example, the oxide thin-film transistors may be low temperature polycrystalline oxide (LTPO) thin-film transistors. However, this is an example, and the N-type transistors are not limited thereto. For example, an active pattern (e.g., a semiconductor layer) included in the transistors may include an inorganic semiconductor (e.g., amorphous silicon or polysilicon) or an organic semiconductor.

In an embodiment, some of the transistors included in the pixel circuit may be N-type oxide thin-film transistors, and others may be P-type silicon thin-film transistors. In the silicon thin-film transistors, an active pattern (e.g., a semiconductor layer) may include amorphous silicon or polysilicon.

In an embodiment, the transistors included in the pixel circuit may be P-type silicon thin-film transistors.

The signal lines for applying an electrical signal to the pixels PX may include gate lines GL extending in the first direction and data lines DL extending in the second direction. The gate lines GL may be spaced apart from each other in the second direction, and may transmit gate signals to the pixels PX. The data lines DL may be spaced apart from each other in the first direction, and may transmit data signals to the pixels PX. Each of the pixels PX may be connected to at least one corresponding gate line from among the gate lines GL and a corresponding data line from among the data lines DL.

Charge sharing circuits CSC and control lines CL (e.g., CL1, CL2, CL3, CL4, CL5, CL6, . . . in FIGS. 6 and 7) may be further positioned in the pixel unit 110. Each of the charge sharing circuits CSC may be provided between a pair of pixel rows, and may be connected to at least one corresponding control line from among the control lines CL. The control lines CL may extend in the first direction, and may be spaced apart from each other in the second direction. FIG. 1 illustrates the charge sharing circuit CSC and a $k^{th}$ control line CLk connected to the pixel PX connected to a data line DLm of an $m^{th}$ pixel column and an $i^{th}$ gate line GLi and the pixel PX connected to the data line DLm of the $m^{th}$ pixel column and a $j^{th}$ gate line GLj. The charge sharing circuit CSC may connect pixel electrodes of a pair of pixels PX by a control signal applied to the $k^{th}$ control line CLk.

The gate driver 130 may be connected to the gate lines GL, and may generate gate signals corresponding to a first driving control signal SCS from the controller 190 and sequentially supply the gate signals to the gate lines GL. The gate line GL may be connected to a gate of a transistor included in the pixel PX, and a gate signal may control turning on and turning off of the transistor to which the gate line GL is connected. The gate signal may be a square wave signal in which an on voltage for turning on the transistor and an off voltage for turning off the transistor are repeated. In an embodiment, the on voltage of the gate signal may be a high-level voltage. A period in which the on voltage of the gate signal is maintained (hereinafter, referred to as an 'on-voltage period') and a period in which the off voltage is maintained (hereinafter, referred to as an 'off-voltage period') may be determined according to a function of the transistor receiving the gate signal in the pixel PX. The gate driver 130 may include a shift register (or stage) for sequentially generating and outputting a gate signal.

The charge sharing driver 150 may be connected to the control lines CL, and may generate control signals corresponding to a second driving control signal CCS from the controller 190 and may sequentially supply the control signals to the control lines CL. The control signal may control turning on and turning off of a transistor including a gate connected to the control line CL. The control signal may be a square wave signal in which an on voltage for turning on the transistor and an off voltage for turning off the transistor are repeated. In an embodiment, the on voltage of the control signal may be a high-level voltage.

The data driver 170 may be connected to the data lines DL, and may supply data signals corresponding to a third driving control signal BCS from the controller 190 to the data lines DL. The data signal supplied to the data line DL may be supplied to the pixels PX to which the gate signal is supplied.

In case that the display apparatus is an organic electroluminescent display apparatus, a first power supply voltage ELVDD and a second power supply voltage ELVSS may be supplied to the pixels PX of the pixel unit 110. The first power supply voltage ELVDD may be a high-level voltage provided to a pixel electrode (e.g., a first electrode or an anode) of an organic light-emitting diode included in each pixel PX. The second power supply voltage ELVSS may be a low-level voltage provided to a counter electrode (e.g., a second electrode or a cathode) of the organic light-emitting diode. The first power supply voltage ELVDD and the second power supply voltage ELVSS are driving voltages for causing the pixels PX to emit light. In an embodiment, an initialization voltage Vint may be further supplied to the pixels PX of the pixel unit 110. The initialization voltage Vint may be a voltage applied to the pixel electrode of the organic light-emitting diode at a timing different from a timing at which the first power supply voltage ELVDD is provided to the pixel electrode of the organic light-emitting diode.

The controller 190 may generate the first driving control signal SCS, the second driving control signal CCS, and the third driving control signal BCS based on signals input from the outside. The controller 190 may supply the first driving control signal SCS to the gate driver 130, may supply the second driving control signal CCS to the charge sharing driver 150, and may supply the third driving control signal BCS to the data driver 170.

Figure 3:
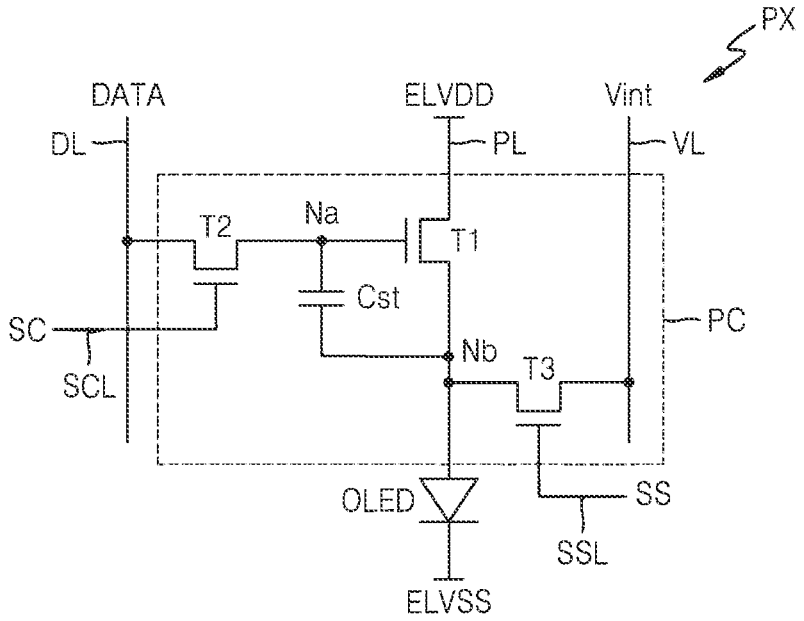
FIG. 3 is a schematic diagram of an equivalent circuit of a pixel according to an embodiment.

Although the pixel PX is connected to one gate line GL in FIG. 1, this is an example, and the pixel PX may be connected to two or more gate lines. For example, as shown in FIG. 3 described below, the pixel PX may be connected to a first gate line SCL and a second gate line SSL, and the gate line GL illustrated in FIG. 1 may include the first gate line SCL and the second gate line SSL. The gate driver 130 may be connected to first gate lines SCL and second gate lines SSL, and may sequentially supply first gate signals SC to the first gate lines SCL and may sequentially supply second gate signals SS to the second gate lines SSL. In an embodiment, timings of on-voltage periods of the first gate signal SC and the second gate signal SS applied to the same row of the pixel unit 110 may be the same.

Although the gate driver 130 and the charge sharing driver 150 are independently configured (or separately implemented) in the embodiment of FIG. 1, this is an example.

In another example, as shown in FIG. 2, in the display apparatus 10A, the charge sharing driver 150 may be omitted, the gate driver 130 may be connected to the gate lines GL and the control lines CL, and may generate gate signals and control signals respectively corresponding to the first driving control signal SCS and the second driving control signal CCS from the controller 190 and may output the gate signals and the control signals to the gate lines GL and the control lines CL. For example, the gate driver 130 may be connected to the first gate lines SCL, the second gate lines SSL, and the control lines CL, and may sequentially supply the first gate signals SC to the first gate lines SCL, may sequentially supply the second gate signals SS to the second gate lines SSL, and may sequentially supply control signals CS to the control lines CL.

In another example, each of the control lines CL may be connected to one of the gate lines GL. For example, the control lines CL may be extension lines of the second gate lines SSL, or may be signal lines connected to the second gate lines SSL. For example, a control signal may be the second gate signal SS applied from the gate driver 130 to the second gate lines SSL. For example, a $k^{th}$ control line CLk illustrated in FIG. 2 may be a second gate line positioned in a pixel row between an $i^{th}$ second gate line SSLi and a $j^{th}$ second gate line SSLj. For example, at least one dummy gate line may be positioned after a last second gate line around the pixel unit 110, and the dummy gate line may receive a second gate signal corresponding to a control signal from the gate driver 130.

FIG. 3 is a schematic diagram of an equivalent circuit of a pixel according to an embodiment.

Referring to FIG. 3, each of the pixels PX may include a pixel circuit PC and an organic light-emitting diode OLED as a display element connected to the pixel circuit PC. The pixel circuit PC may include a first transistor T1, a second transistor T2, a third transistor T3, and a capacitor Cst.

The first transistor T1 (e.g., a driving transistor) may include a first terminal connected to a driving voltage line PL for supplying the first power supply voltage ELVDD, and a second terminal connected to a second node Nb. A gate of the first transistor T1 may be connected to a first node Na. The first transistor T1 may control driving current flowing from the driving voltage line PL to the organic light-emitting diode OLED in response to a voltage stored in the capacitor Cst. The first node Na may be a node to which the gate of the first transistor T1 and a second terminal of the second transistor T2 are connected, and the second node Nb may be a node to which the second terminal of the first transistor T1 and a pixel electrode of the organic light-emitting diode OLED are connected.

The second transistor T2 (e.g., a data writing transistor) may include a gate connected to the first gate line SCL, a first terminal connected to the data line DL, and the second terminal connected to the first node Na. The second transistor T2 may be turned on according to the first gate signal SC input through the first gate line SCL to connect (e.g., electrically connect) the data line DL to the first node Na, and may transmit a data signal DATA input through the data line DL to the first node Na.

The third transistor T3 (e.g., an initialization transistor) may include a gate connected to the second gate line SSL, a first terminal connected to the second terminal of the first transistor T1, and a second terminal connected to an initialization line VL. The third transistor T3 may be turned on by the second gate signal SS supplied through the second gate line SSL, and may transmit the initialization voltage Vint input through the initialization line VL to the second node Nb.

The capacitor Cst may be connected between the first node Na and the second node Nb. A first terminal of the capacitor Cst may be connected to the first node Na, and a second terminal may be connected to the second node Nb. The capacitor Cst may store a voltage corresponding to a difference between a voltage received from the second transistor T2 and a voltage of the second terminal of the first transistor T1.

The organic light-emitting diode OLED may include the pixel electrode (e.g., a first electrode or an anode) connected to the second node Nb and a counter electrode (e.g., a second electrode or a cathode) to which the second power supply voltage ELVSS is applied. The organic light-emitting diode OLED may emit light having a certain luminance due to driving current.

In the following embodiments, for convenience of explanation, in case that an arbitrary signal is supplied (or applied), it means that a signal of an on-voltage level (e.g., a high voltage level) is supplied (or applied), and in case that an arbitrary signal is not supplied (or applied), it means that a signal of an off-voltage level (e.g., a low voltage level) is supplied. A timing at which an arbitrary signal is applied at an on-voltage level may refer to a start timing of the signal, and a timing at which the signal transitions from the on-voltage level to an off-voltage level may refer to an end timing of the signal.

Data output from the controller 190 may be input to the data driver 170, and the data driver 170 may generate the data signal DATA corresponding to the data and may output the generated data signal DATA to the data line DL.

The first gate signal SC and the second gate signal SS may be respectively supplied from the gate driver 130 to the first gate line SCL and the second gate line SSL. In the pixels PX of a pixel row receiving the first gate signal SC and the second gate signal SS, the second transistor T2 and the third transistor T3 may be turned on. In case that the second transistor T2 is turned on, the data signal DATA from the data line DL may be transmitted to the first node Na of the pixel PX. In case that the third transistor T3 is turned on, the initialization voltage Vint from the initialization line VL may be transmitted to the second node Nb of the pixel PX. Accordingly, the pixel electrode of the organic light-emitting diode OLED connected to the second node Nb may be initialized (e.g., reset or discharged) to the initialization voltage Vint. A voltage between the first node Na and the second node Nb may be charged in the capacitor Cst.

Thereafter, the first transistor T1 may be turned on, and the turned-on first transistor T1 may supply driving current corresponding to the data signal to the organic light-emitting diode OLED. Accordingly, the driving current flows along a current path from the driving voltage line PL through the first transistor T1 and the organic light-emitting diode OLED. The pixel electrode of the organic light-emitting diode OLED may start to be charged from the initialization voltage Vint to a voltage (e.g., a light-emitting voltage) corresponding to the driving current, and may emit light with a luminance corresponding to the driving current.

Each pixel PX may discharge the pixel electrode charged to a voltage corresponding to driving current of a current frame before charging the pixel electrode to a voltage corresponding to driving current of a next frame. In the pixel PX, charging and discharging of the pixel electrode may be performed with a certain time difference, and may be sequentially performed in units of pixel rows. According to an embodiment, a charging speed of a pixel electrode may be increased by connecting a pixel electrode of a pixel requiring charging of the pixel electrode to a pixel electrode of a pixel before discharging in another pixel row. Accordingly, power consumption of the display apparatus may be reduced.

Although the transistors of the pixel circuit are N-type transistors in FIG. 3, Embodiments are not limited thereto. According to various embodiments, for example, the transistors of the pixel circuit may be P-type transistors, or some may be P-type transistors and others may be N-type transistors.

According to an embodiment, at least the first transistor T1 may be an oxide semiconductor thin-film transistor including an active layer formed of an amorphous or crystalline oxide semiconductor. For example, the first through third transistors T1 through T3 may be oxide semiconductor thin-film transistors. The oxide semiconductor thin-film transistors have excellent off-current characteristics. In another example, at least one of the first through third transistors T1 through T3 may be a low temperature polysilicon (LTPS) thin-film transistor including an active layer formed of polysilicon. The LTPS thin-film transistor has high electron mobility, and thus, has fast driving characteristics.

Figure 4:
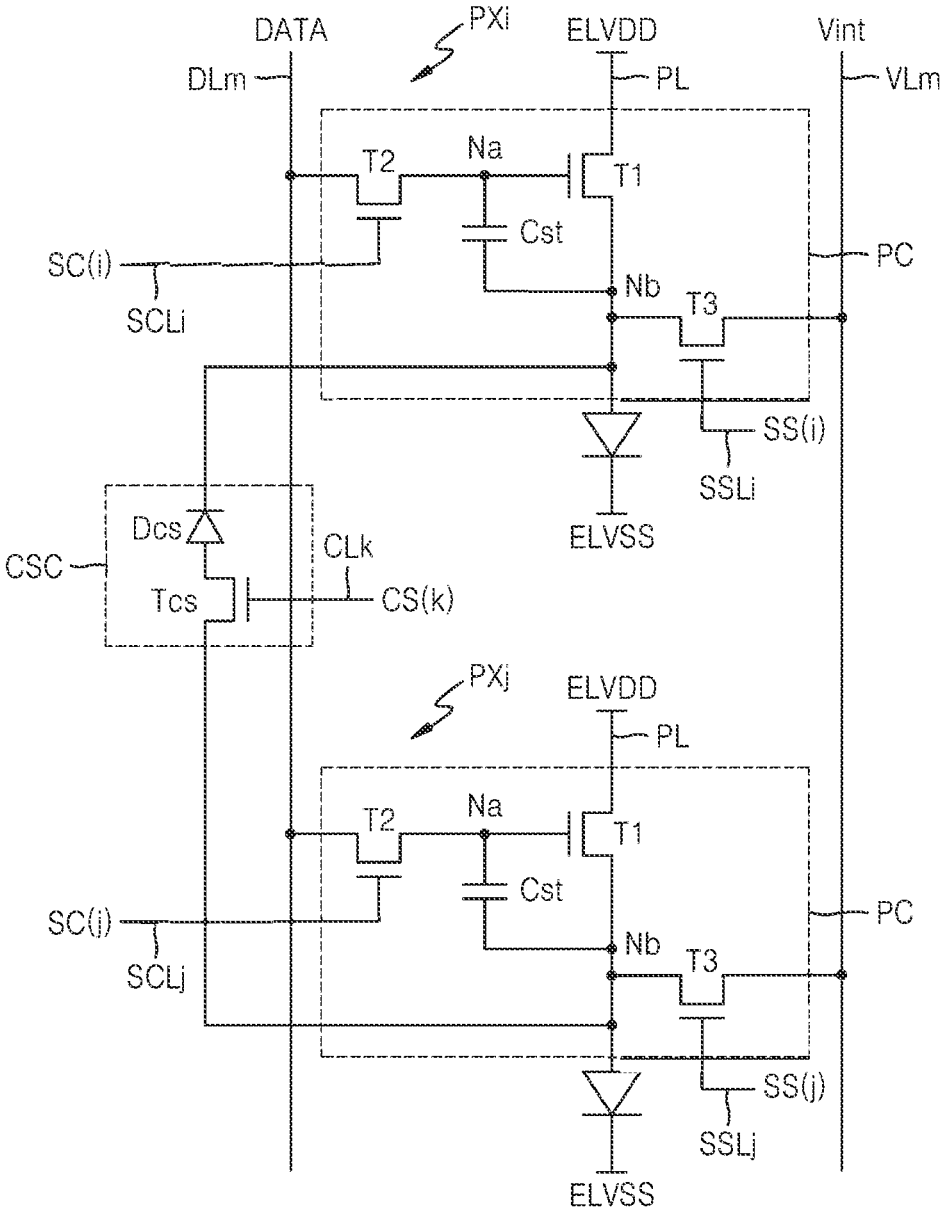
FIG. 4 is a schematic diagram illustrating a charge sharing circuit according to an embodiment.
Figure 5:
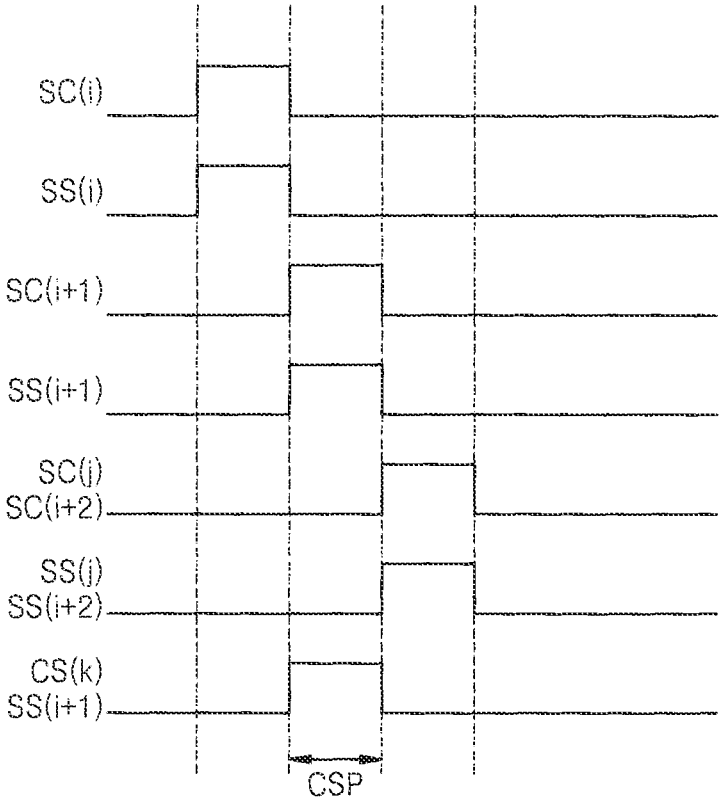
FIG. 5 is a schematic diagram illustrating signals for describing an operation of the charge sharing circuit of FIG. 4.

FIG. 4 is a schematic diagram illustrating a charge sharing circuit according to an embodiment. FIG. 5 is a schematic diagram illustrating signals for describing an operation of the charge sharing circuit of FIG. 4.

In each pixel column, the charge sharing circuit CSC may selectively connect pixel electrodes of the pixels PX positioned in two pixel rows that are spaced apart from each other by a certain interval. The charge sharing circuit CSC may connect a first pixel of an $i^{th}$ pixel row in which a pixel electrode starts to be charged in response to the control signal CS to a second pixel of a $j^{th}$ pixel row in which a pixel electrode is completely charged and is not yet discharged. The charge sharing circuit CSC may connect the pixel electrode of the first pixel of the $i^{th}$ pixel row to the pixel electrode of the second pixel of the $j^{th}$ pixel row in case that the pixel electrode of the $i^{th}$ pixel row is charged. The $j^{th}$ pixel row may be a pixel row spaced apart by a certain number of pixel rows from the $i^{th}$ pixel row. For example, the $j^{th}$ pixel row may be a pixel row spaced apart by two pixel rows from the $i^{th}$ pixel row.

The charge sharing circuit CSC may include a control transistor Tcs and a control diode Dcs. The control transistor Tcs may be connected between the pixel electrode of the first pixel of the $i^{th}$ pixel row and the the pixel electrode of the second pixel of the $j^{th}$ pixel row, and a gate of the control transistor Tcs may be connected to the $k^{th}$ control line CLk. In an embodiment, the control line CL may be a gate control line separate from first gate lines SCL and second gate lines SSL of the $i^{th}$ pixel row and the $j^{th}$ pixel row. In another example, the $k^{th}$ control line CLk may be a gate line positioned in one of at least one pixel row between the $i^{th}$ pixel row and the $j^{th}$ pixel row. For example, the $k^{th}$ control line CLk may be the second gate line SSL positioned in a pixel row between the $i^{th}$ pixel row and the $j^{th}$ pixel row. In an embodiment, the $j^{th}$ pixel row may be an $i+2^{th}$ pixel row, and the $k^{th}$ control line CLk may be a second gate line SSLi+1 positioned in an $i+1^{th}$ pixel row between a second gate line SSLi of the $i^{th}$ pixel row and a second gate line SSLi+2 of the $i+2^{th}$ pixel row. The control diode Dcs may be connected between the pixel electrode of the first pixel and the control transistor Tcs. In the control diode Dcs, an anode of the control diode Dcs may be connected to the control transistor Tcs, and a cathode of the control diode Dcs may be connected to the pixel electrode of the first pixel. In another example, the control diode Dcs may be omitted. For example, in case that the control diode Dcs is not reverse-biased within an on-voltage period of a control signal, the control diode Dcs may be omitted.

The control signal CS may be applied for a certain time within a period from a timing at which the pixel electrode of the first pixel starts to be charged to a timing at which the pixel electrode of the second pixel starts to be discharged. In an embodiment, the control signal CS may be applied to the gate of the control transistor Tcs between the second gate signal SS applied to a gate of the third transistor T3 of the first pixel and the second gate signal SS applied to a gate of the third transistor T3 of the second pixel.

A start timing of the control signal CS applied to the charge sharing circuit CSC may be an end timing of the second gate signal SS applied to the first pixel, and an end timing of the control signal CS may be a start timing of the second gate signal SS applied to the second pixel, to connect the pixel electrode of the first pixel to the pixel electrode of the second pixel. The control signal CS may not overlap the second gate signal SS applied to the first pixel and the second gate signal SS applied to the second pixel.

FIG. 4 illustrates the first pixel PXi of the $i^{th}$ pixel row and the second pixel PXj of the $j^{th}$ pixel row connected to a data line DLm and an initialization line VLm of an $m^{th}$ pixel column, and the $k^{th}$ charge sharing circuit CSC that selectively connects the pixel electrodes of the first pixel PXi and the second pixel PXj.

A gate of a second transistor T2 of the first pixel PXi may be connected to the first gate line SCLi, and the gate of the third transistor T3 may be connected to the second gate line SSLi. A gate of a second transistor T2 of the second pixel PXj may be connected to the first gate line SCLj, and the gate of a third transistor T3 of the second pixel PXj may be connected to the second gate line SSLj. In the display apparatus in which second gate signals are sequentially output without overlapping each other, the $j^{th}$ pixel row may be an $i+2^{th}$ pixel row spaced apart by two pixel rows from the $i^{th}$ pixel row. For example, the first gate line SCLj and the second gate line SSLj of the $j^{th}$ pixel row may be respectively a first gate line SCLi+2 and a second gate line SSLi+2 of the $i+2^{th}$ pixel row.

The control transistor Tcs may be connected between the control diode Dcs and the pixel electrode of the second pixel PXj, and the gate of the control transistor Tcs may be connected to the $k^{th}$ control line CLk. The control diode Dcs may be connected between the pixel electrode of the first pixel PXi and the control transistor Tcs. In an embodiment, the $k^{th}$ control line CLk may be a gate control line separate from the first gate lines SCLi and SCLj and the second gate lines SSLi and SSLj positioned in the $i^{th}$ pixel row and the $j^{th}$ pixel row. In another example, the $k^{th}$ control line CLk may be a gate line between the second gate line SSLi of the $i^{th}$ pixel row and the second gate line SSLj of the $j^{th}$ pixel row, for example, a second gate line SSLi+1 of the $(i+1)^{th}$ pixel row.

In each pixel row, the first gate signal SC and the second gate signal SS may be applied to a pixel at the same timing. For example, timings at which the first gate signal SC and the second gate signal SS output an on-voltage level may be the same. Referring to FIG. 5, timings of first gate signals SC(i), SC(i+1), and SC(i+2) (or SC(j)) sequentially applied to the $i^{th}$ pixel row, the $i+1^{th}$ pixel row, and the $i+2^{th}$ pixel row may be the same as timings of second gate signals SS(i), SS(i+1), and SS(i+2) sequentially applied to the $i^{th}$ pixel row, the $i+1^{th}$ pixel row, and the $i+2^{th}$ pixel row.

A control signal CS(k) applied to the $k^{th}$ control line CLk may be applied within a period from a timing at which the pixel electrode of the first pixel PXi starts to be charged after discharging to a timing before the pixel electrode of the second pixel PXj starts to be discharged. The control signal CS(k) may be applied to the gate of the control transistor Tcs at an on-voltage level within a charge sharing period CSP from a time in case that the second gate signal SS(i) of the first pixel PXi changes to an off-voltage level to a time in case that the second gate signal SS(i+2) of the second pixel PXj changes to an on-voltage level. In an embodiment, the control signal CS(k) may be a second gate signal SS(i+1) applied to pixels of the $i+1^{th}$ pixel row. The second gate signal SS(i+2) of the second pixel PXj may follow (or be applied after) the second gate signal SS(i) of the first pixel PXi after (or by) a certain time, and may not overlap the second gate signal SS(i) of the first pixel PXi. The control signal CS(k) may be applied later than the second gate signal SS(i) of the first pixel PXi, and may be applied earlier than the second gate signal SS(i+2) of the second pixel PXj. The control signal CS(k) may be positioned between the second gate signal SS(i) of the first pixel PXi and the second gate signal SS(i+2) of the second pixel PXj, and may not overlap the second gate signal SS(i) of the first pixel PXi and the second gate signal SS(i+2) of the second pixel PXj.

An on-voltage period (about 1 H) of the second gate signals SS(i), SS(i+1), and SS(i+2) may be the same as an on-voltage period (about 1 H) of the control signal CS(k). The on-voltage period of the control signal CS(k) may overlap the on-voltage period of the second gate signal SS(i+1).

The control transistor Tcs may be turned on by the control signal CS(k) applied to the $k^{th}$ control line CLk, and the control diode Dcs may be forward-biased. Accordingly, a current path may be formed from the pixel electrode of the second pixel PXj to the pixel electrode of the first pixel PXi, and a charging speed of the pixel electrode of the first pixel PXi may be increased. The on-voltage period of the control signal CS(k) may be the same as the charge sharing period CSP. In case that a voltage of the pixel electrode of the first pixel PXi is greater than a voltage of the pixel electrode of the second pixel PXj within the on-voltage period of the control signal CS(k), the control diode Dcs may be reverse-biased to block a current flow from the pixel electrode of the second pixel PXj to the pixel electrode of the first pixel PXi.

Figure 6:
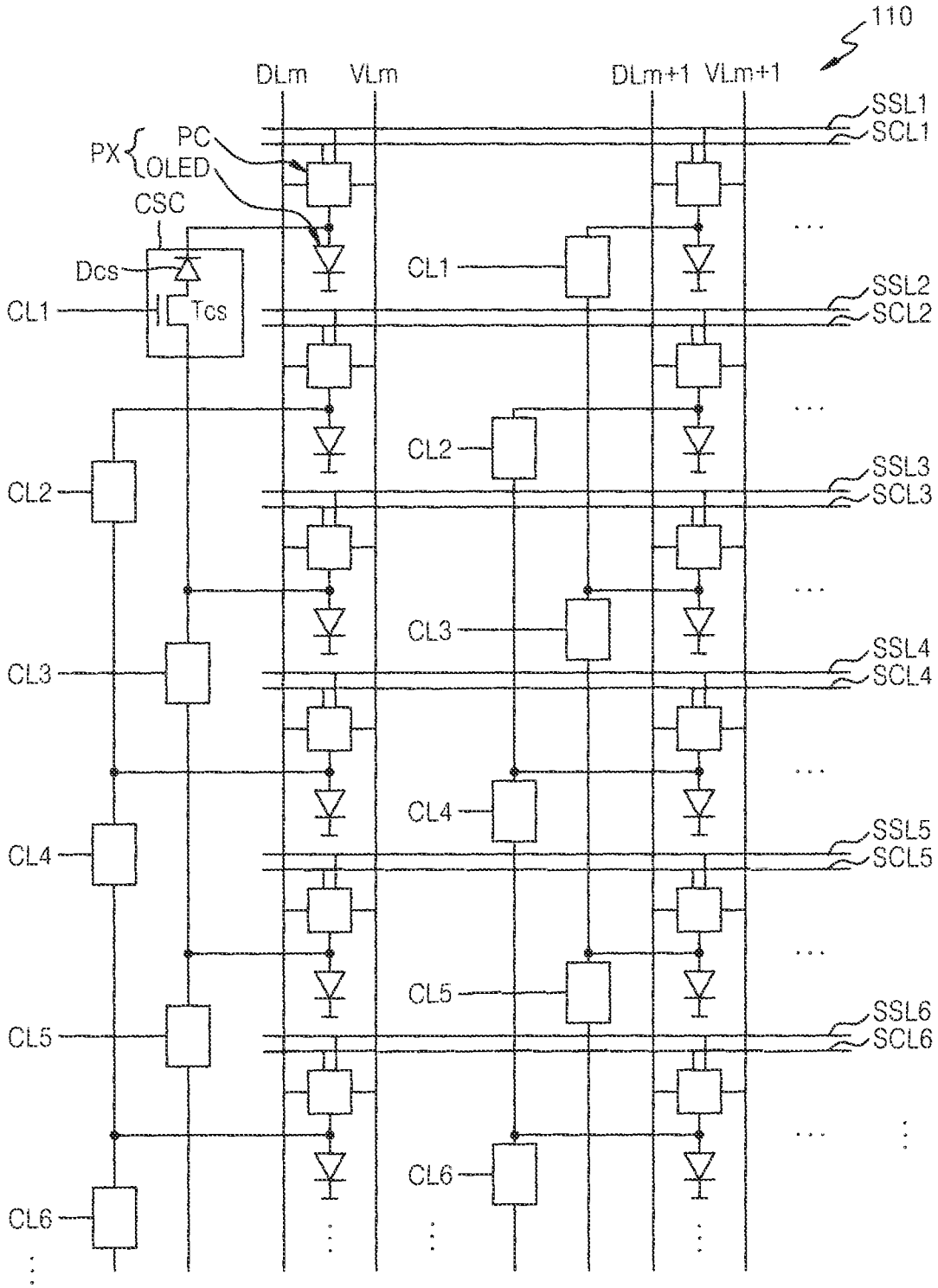
FIGS. 6 and 7 are schematic diagrams illustrating a part of a pixel unit according to an embodiment.
Figure 7:
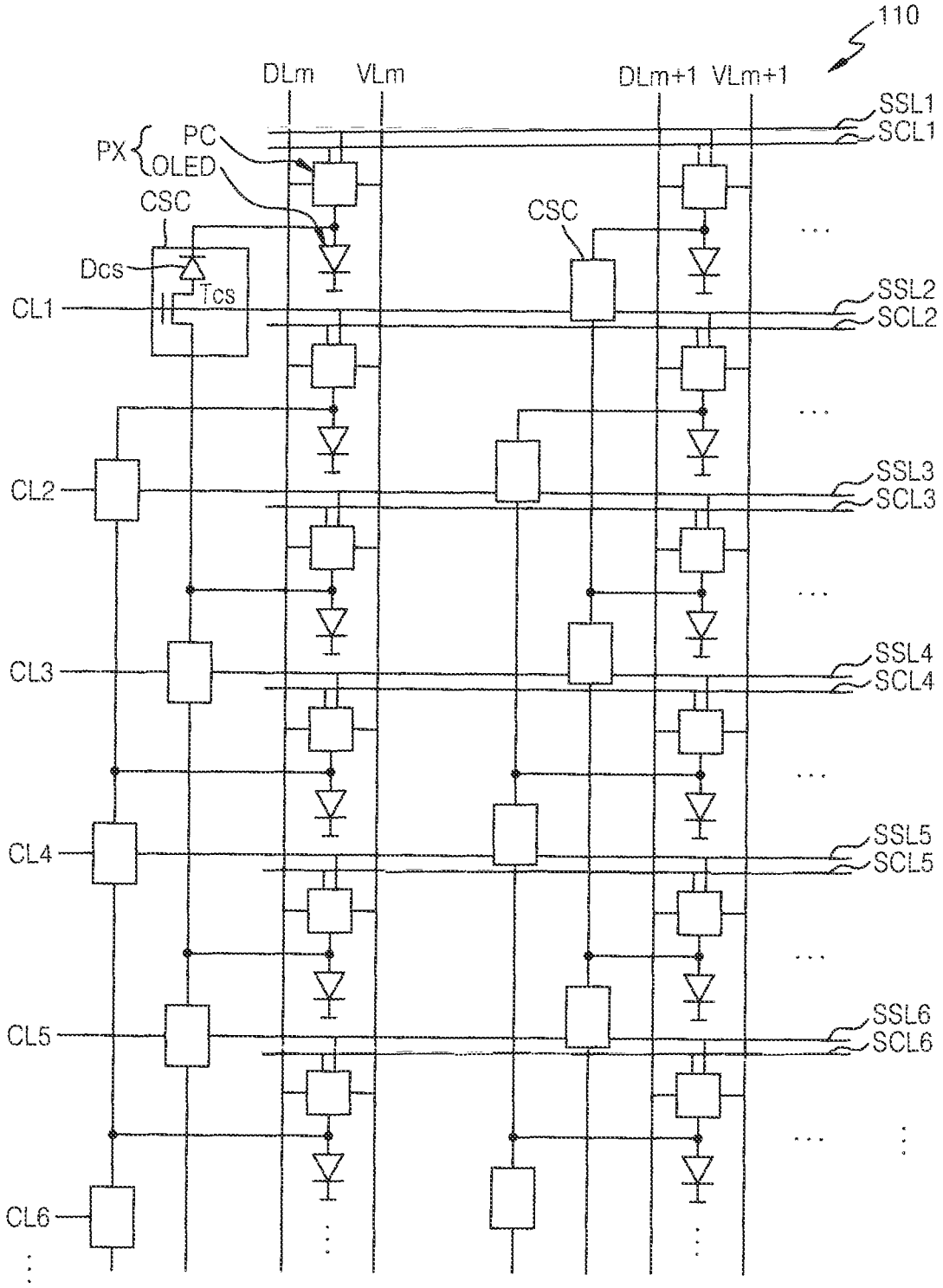

FIGS. 6 and 7 are schematic diagrams illustrating a part of a pixel unit according to an embodiment.

Referring to FIG. 6, each pixel PX of the pixel unit 110 (see FIG. 1) may include the pixel circuit PC and the organic light-emitting diode OLED connected to the pixel circuit PC, and a pixel electrode of the organic light-emitting diode OLED may be connected to the charge sharing circuit CSC. Pixel electrodes of some pixels PX may be connected to two different charge sharing circuits CSC, and may supply current to a pixel electrode of the pixel PX of another pixel row or may receive current from a pixel electrode of the pixel PX of another pixel row.

Each pixel circuit PC may be connected to the data line DL of a corresponding pixel column from among data lines . . . , DLm, DLm+1, . . . , a corresponding initialization line VL from among initialization lines . . . , VLm, VLm+1, . . . , and the first gate line SCL and the second gate line SSL of a corresponding pixel row. For example, the pixel circuit PC of the pixel PX arranged in a second pixel row and an $m^{th}$ pixel column may be connected to a data line DLm and an initialization line VLm of the $m^{th}$ pixel column, and a first gate line SCL2 and a second gate line SSL2 of the second pixel row. The first gate signal SC and the second gate signal SS may be sequentially and respectively supplied to the first gate line SCL and the second gate line SSL from a first pixel row.

The charge sharing circuit CSC may be provided between a pair of pixel rows in each column, and a gate of the control transistor Tcs in the charge sharing circuit CSC may connect pixel electrodes of a pair of pixels connected to the charge sharing circuit CSC in response to the control signal CS applied to the control line CL. As shown in FIG. 6, in an embodiment, the charge sharing circuit CSC may be provided between a pair of adjacent odd rows and a pair of adjacent even rows. For example, the control transistor Tcs in which the gate is connected to a first control line CL1 may connect a pixel electrode of the pixel PX of a first pixel row to a pixel electrode of the pixel PX of a third pixel row in case that a control signal is applied to the first control line CL1. The control transistor Tcs in which the gate is connected to a second control line CL2 may connect a pixel electrode of the pixel PX of a second pixel row to a pixel electrode of the pixel PX of a fourth pixel row in case that a control signal is applied to the second control line CL2. The control transistor Tcs in which the gate is connected to a third control line CL3 may connect the pixel electrode of the pixel PX of the third pixel row to a pixel electrode of the pixel PX of a firth pixel row in case that a control signal is applied to the third control line CL3.

The control signal may be sequentially supplied from the first control line CL1 to a last control line. As shown in FIG. 6, the control lines CL (e.g., CL1, CL2, CL3, CL4, CL5, CL6, . . . ) may be a gate control line separate from the first gate line SCL and the second gate line SSL.

In another example, the control lines CL may be the second gate line SSL of a pixel row between an $i^{th}$ pixel row and a $j^{th}$ pixel row. In an embodiment of FIG. 7, the charge sharing circuit CSC provided between a pair of odd rows may receive a second gate signal, as a control signal, applied to the second gate line SSL of an even row provided between the pair of odd rows. The charge sharing circuit CSC provided between a pair of even rows may receive a second gate signal, as a control signal, applied to the second gate line SSL of an odd row between the pair of even rows. For example, the charge sharing circuit CSC between a first pixel row and a third pixel row may include the control transistor Tcs in which the gate is connected to a second gate line SSL2 of a second pixel row, and the control transistor Tcs may be turned on by receiving a second gate signal as a control signal, to connect a pixel electrode of the pixel PX of the first pixel row to a pixel electrode of the pixel PX of the third pixel row. The charge sharing circuit CSC between the second pixel row and a fourth pixel row may include the control transistor Tcs in which the gate is connected to a second gate line SSL3 of the third pixel row, and the control transistor Tcs may be turned on by receiving a second gate signal as a control signal, to connect a pixel electrode of the pixel PX of the second pixel row to a pixel electrode of the pixel PX of the fourth pixel row. The charge sharing circuit CSC between the third pixel row and a fifth pixel row may include the control transistor Tcs in which the gate is connected to a second gate line SSL4 of the fourth pixel row, and the control transistor Tcs may be turned on by receiving a second gate signal as a control signal, to connect the pixel electrode of the pixel PX of the third pixel row to a pixel electrode of the pixel PX of the fifth pixel row.

Figure 8:
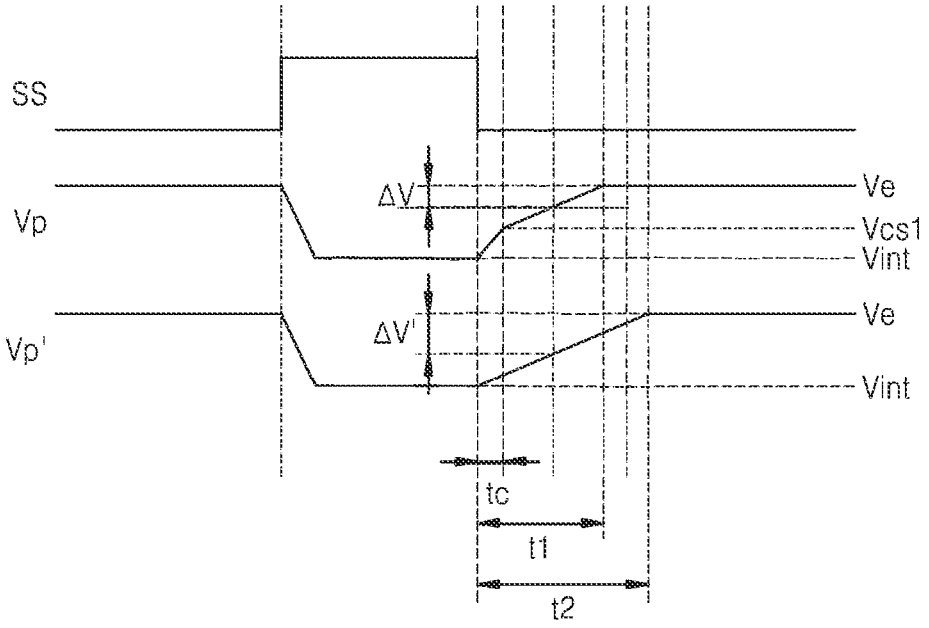
FIGS. 8 and 9 are schematic diagrams for describing a voltage change of a pixel electrode according to an embodiment.
Figure 9:
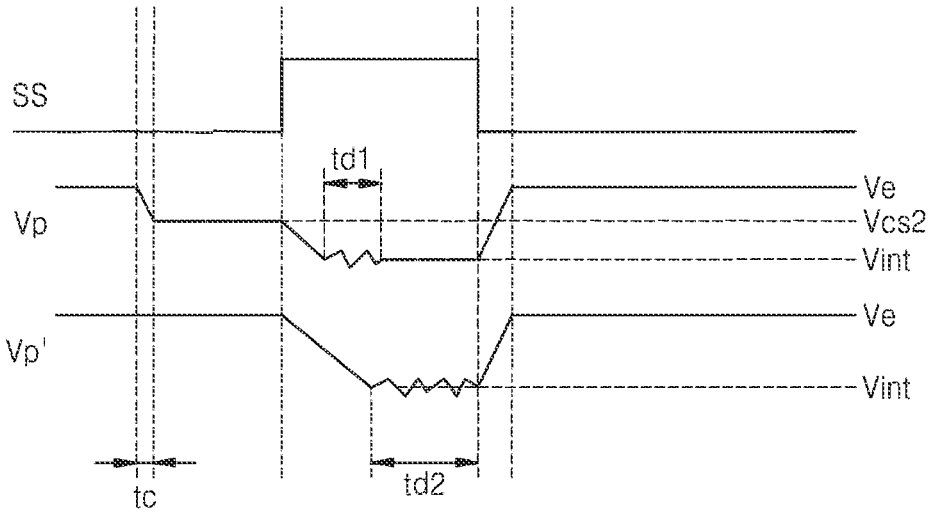

FIGS. 8 and 9 are schematic diagrams for describing a voltage change of a pixel electrode according to an embodiment.

In FIGS. 8 and 9, a pixel electrode voltage Vp is a voltage of a pixel electrode in case that the charge sharing circuit CSC according to an embodiment is applied, and a comparative pixel electrode voltage Vp' is a voltage of a pixel electrode in a comparative example in which the charge sharing circuit CSC is not applied. FIG. 8 is a schematic diagram for describing a voltage change in case that a pixel electrode of a pixel is charged after discharging, and a discharge voltage change of the pixel electrode is omitted for convenience of explanation. FIG. 9 is a schematic diagram for describing a voltage change in case that a pixel electrode of a pixel is discharged from before discharging, and a charge voltage change of the pixel electrode is omitted for convenience of explanation. In the following description, for convenience of explanation, a pixel that receives current from a pixel electrode of a pixel of another pixel row is referred to as a first pixel, and a pixel that supplies current to a pixel electrode of a pixel of another pixel row is referred to as a second pixel.

Referring to the comparative example of FIG. 8, in case that the second gate signal SS is applied to the first pixel (in case that the second gate signal SS is applied at a high level (e.g., an on-voltage level)), the third transistor T3 may be turned on and a pixel electrode maintaining a light-emitting voltage Ve may be discharged, and the comparative pixel electrode voltage Vp' may decrease from the light-emitting voltage Ve to the initialization voltage Vint with a certain gradient. In case that the second gate signal SS transitions from a high level to a low level (e.g., an off-voltage level), the third transistor T3 may be turned off and the pixel electrode starts to be charged, and the comparative pixel electrode voltage Vp' may increase from the initialization voltage Vint to the light-emitting voltage Ve with a certain gradient (or slope).

According to an embodiment, the first pixel and the second pixel may be connected to the charge sharing circuit CSC, and in case that the control signal CS is applied to the charge sharing circuit CSC (in case that the control signal CS is applied at a high level (e.g., an on-voltage level)) at a timing in case that the pixel electrode of the first pixel starts to be charged, the control transistor Tcs may be turned on, the control diode Dcs may be forward-biased, and the pixel electrode of the first pixel may share charges with the pixel electrode of the second pixel. Accordingly, as shown in FIG. 8, the pixel electrode voltage Vp of the first pixel may rapidly increase from the initialization voltage Vint to an intermediate voltage Vcs1 at a first slew rate (or a first rising rate) of a first gradient (or a first slope) due to charge sharing during an initial period tc of a period for which the control signal CS is applied. The pixel electrode voltage Vp of the first pixel may increase from the intermediate voltage Vcs1 to the light-emitting voltage Ve at a second slew rate (or a second rising rate) of a second gradient (or a second slope).

A time t1 for which the pixel electrode voltage Vp according to an embodiment increases from the initialization voltage Vint to the light-emitting voltage Ve may be shorter than a time t2 for which the comparative pixel electrode voltage Vp' according to the comparative example increases from the initialization voltage Vint to the light-emitting voltage Ve, and thus, a charging speed of the pixel electrode voltage Vp may be higher than a charging speed of the comparative pixel electrode voltage Vp'. The first slew rate and the second slew rate during the time t1 for which the pixel electrode voltage Vp according to an embodiment is charged may be greater than a slew rate during the time t2 for which the comparative pixel electrode voltage Vp' is charged. Accordingly, in case that the charge sharing circuit CSC of the disclosure is applied to a display apparatus supporting a variable refresh rate (VRR), flicker occurring due to a low slew rate may be reduced.

Also, a voltage difference ΔV of the pixel electrode voltage Vp over time in an embodiment may be less than a voltage difference ΔV' of the comparative pixel electrode voltage Vp' over time in the comparative example. Accordingly, a luminance difference of a pixel over time in an embodiment may be less than a luminance difference of a pixel over time in the comparative example, and thus, image quality may be improved.

Referring to the comparative example of FIG. 9, in case that the second gate signal SS is applied to the second pixel (in case that the second gate signal SS is applied at a high level (e.g., an on-voltage level)), the third transistor T3 may be turned on and a pixel electrode maintaining the light-emitting voltage Ve may be discharged, and the comparative pixel electrode voltage Vp' may decrease from the light-emitting voltage Ve to the initialization voltage Vint with a certain gradient. In case that the second gate signal transitions from a high level to a low level (e.g., an off-voltage level), the third transistor T3 may be turned off and the pixel electrode may start to be charged, and thus, the comparative pixel electrode voltage Vp' may increase from the initialization voltage Vint to the light-emitting voltage Ve with a certain gradient. In case that the pixel electrode of the second pixel is discharged, the initialization voltage Vint may be unstably applied to the pixel electrode due to a large change in the comparative pixel electrode voltage Vp'.

According to an embodiment, the first pixel and the second pixel may be connected to the charge sharing circuit CSC, and in case that the control signal CS is applied to the charge sharing circuit CSC (in case that the control signal CS is applied at a high level (e.g., an on-voltage level)) before the second gate signal SS is applied to the second pixel, e.g., before the second pixel is discharged, the control transistor Tcs may be turned on, the control diode Dcs may be forward-biased, and the pixel electrode of the second pixel may share charges with the pixel electrode of the first pixel. Accordingly, as shown in FIG. 9, the pixel electrode voltage Vp of the second pixel may rapidly decrease from the light-emitting voltage Ve to an intermediate voltage Vcs2 at a third slew rate (or a first falling rate) of a third gradient (or a third slope) due to charge sharing with the pixel electrode of the first pixel during the initial period tc of a period for which the control signal CS is applied. In case that the second gate signal SS is applied, the pixel electrode voltage Vp of the second pixel may decrease from the intermediate voltage Vcs2 to the initialization voltage Vint at a fourth slew rate (or a second falling rate) of a fourth gradient (or a fourth slope). For example, because the pixel electrode voltage Vp is discharged from the intermediate voltage Vcs2 lower than the light-emitting voltage Ve to the initialization voltage Vint, a voltage change during discharging of the pixel electrode voltage Vp may be less than that in the comparative example. Accordingly, a period td1 for which the initialization voltage Vint is unstably applied according to an embodiment may be shorter than a period td2 for which the initialization voltage Vint is unstably applied according to the comparative example. Accordingly, the initialization voltage Vint applied to the pixel electrode during discharging of the pixel electrode of the second pixel may be stabilized early.

Figure 10:
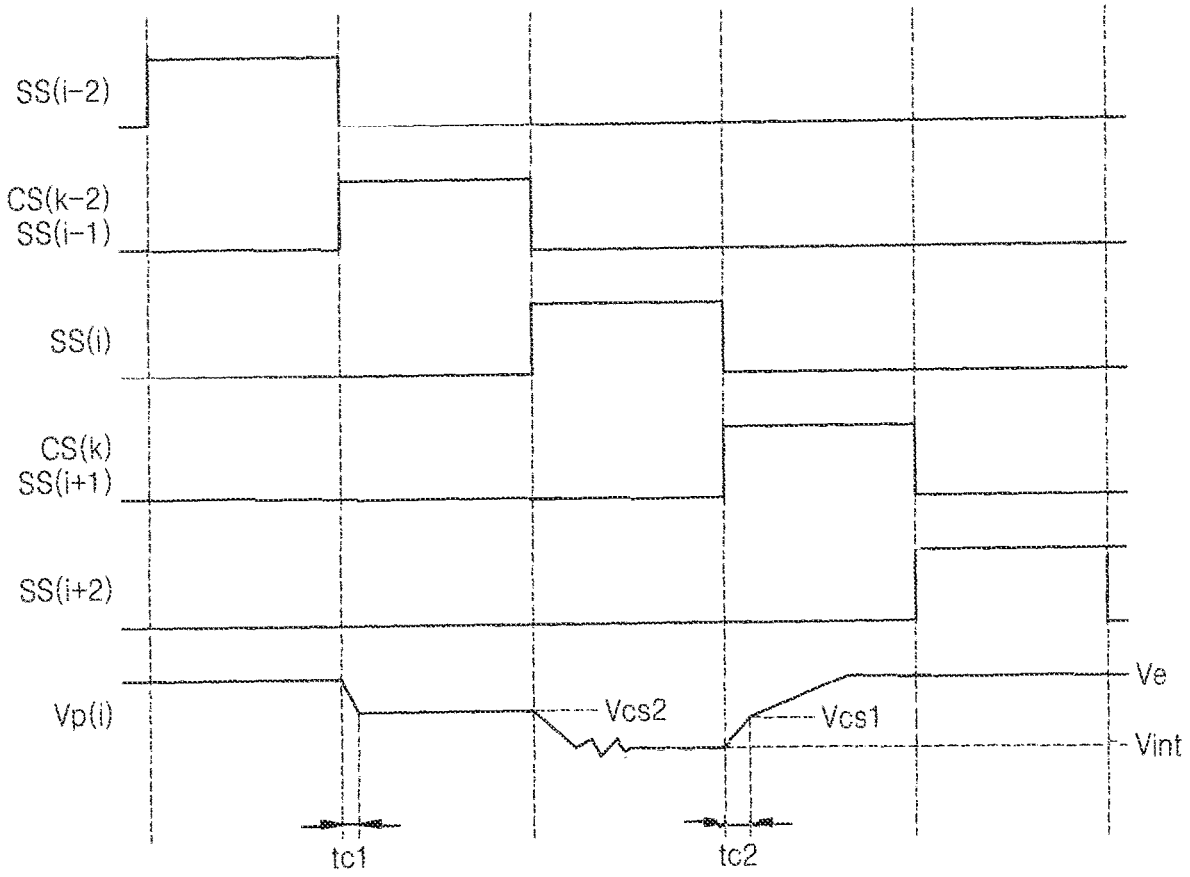
FIG. 10 is a schematic diagram for describing charge and discharge voltage changes of a pixel electrode according to an embodiment.

FIG. 10 is a schematic diagram for describing charge and discharge voltage changes of a pixel electrode according to an embodiment.

FIG. 10 illustrates a second gate signal, a control signal, and a pixel electrode voltage, in an example where a pixel PXa of an $i^{th}$ pixel row and a pixel PXb of an $i-2^{th}$ pixel row are connected to a first charge sharing circuit CSC and the pixel PXa of the $i^{th}$ pixel row and a pixel PXc of an $i+2^{th}$ pixel row are connected to a second charge sharing circuit CSC, in a display apparatus in which a second gate signal is sequentially applied to pixel rows without overlapping.

A control signal CS(k−2) may be applied to the first charge sharing circuit CSC between a second gate signal SS(i−2) applied to the pixel PXb and a second gate signal SS(i) applied to the pixel PXa. A control signal CS(k) may be applied to the second charge sharing circuit CSC between the second gate signal SS(i) applied to the pixel PXa and a second gate signal SS(i+2) applied to the pixel PXc. In an embodiment, the control signals CS(k−2) and CS(k) may be signals separate from gate signals. In another example, the control signal CS(k−2) may be a second gate signal SS(i−1) applied to an $i-1^{th}$ pixel row, and the control signal CS(k) may be a second gate signal SS(i+1) applied to an $i+1^{th}$ pixel row.

Referring to FIG. 10, the control signal CS(k−2) may be applied to the first charge sharing circuit CSC at a timing when a pixel electrode of the pixel PXb starts to be charged, and a current path may be formed from a pixel electrode of the pixel PXa to the pixel electrode of the pixel PXb by the control diode Dcs that is forward-biased and the turned-on control transistor Tcs of the first charge sharing circuit CSC. Accordingly, a pixel electrode voltage Vp(i) of the pixel PXa may gradually decrease from the light-emitting voltage Ve to the intermediate voltage Vcs2 due to charge sharing during an initial period tc1 of a period for which the control signal CS(k−2) is applied, and in case that the second gate signal SS(i) is applied, may gradually decrease from the intermediate voltage Vcs2 to the initialization voltage Vint.

The pixel electrode voltage Vp(i) of the pixel PXa may maintain the intermediate voltage Vcs2 after decreasing from the light-emitting voltage Ve to the intermediate voltage Vcs2 at the third slew rate during the initial period tc1 of the period for which the control signal CS(k−2) is applied, and may decrease from the intermediate voltage Vcs2 to the initialization voltage Vint at the fourth slew rate during a period for which the second gate signal SS(i) is applied. The third slew rate may be greater than the fourth slew rate.

The control signal CS(k) may be applied to the second charge sharing circuit CSC at a timing in case that the pixel electrode of the pixel PXa starts to be charged, and a current path may be formed from a pixel electrode of the pixel PXc to the pixel electrode of the pixel PXa due to the control diode Dcs that is forward-biased and the turned-on control transistor Tcs of the second charge sharing circuit CSC. Accordingly, the pixel electrode voltage Vp(i) of the pixel PXa may gradually increase from the initialization voltage Vint to the intermediate voltage Vcs1 due to charge sharing during an initial period tc2 of a period for which the control signal CS(k) is applied. For example, the pixel electrode voltage Vp(i) of the pixel PXa may gradually increase from the intermediate voltage Vcs1 to the light-emitting voltage Ve.

The pixel electrode voltage Vp(i) of the pixel PXa may increase from the initialization voltage Vint to the intermediate voltage Vcs1 at the first slew rate during the initial period tc2 of the period for which the control signal CS(k) is applied, and may increase from the intermediate voltage Vcs1 to the light-emitting voltage Ve at the second slew rate during a period subsequent to the initial period tc2. The first slew rate may be greater than the second slew rate.

Although a control signal is applied in synchronization with a timing at which a pixel electrode of a pixel starts to be charged in the above embodiments, Embodiments are not limited thereto.

Figure 11:
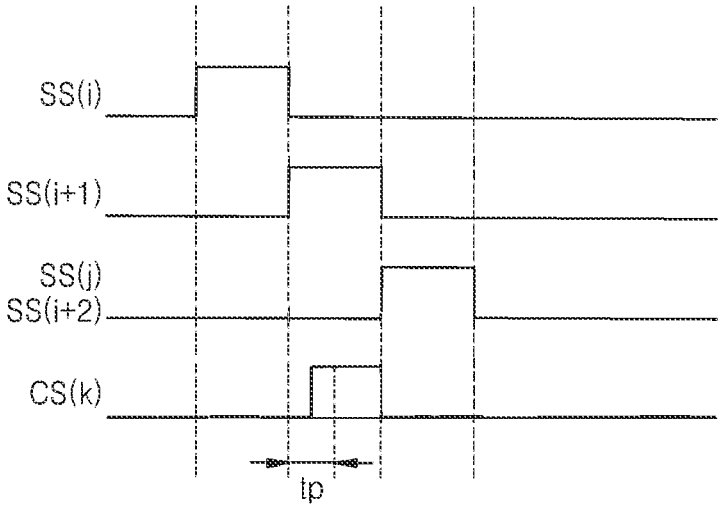
FIG. 11 is a schematic diagram illustrating timings of a gate signal and a control signal according to an embodiment.

FIG. 11 is a schematic diagram illustrating timings of a gate signal and a control signal according to an embodiment.

The control signal CS(k) may be applied in case that a certain time elapses after the second gate signal SS(i) of the first pixel PXi. A start timing of the control signal CS(k) may be adjusted within a range tp of a certain period from a start timing of the charge sharing period CSP. The start timing of the control signal CS(k) may be adjusted within the range tp of a certain period from an end timing of the second gate signal SS(i) applied to the $i^{th}$ pixel row. An end timing of the control signal CS(k) may be a start timing of the second gate signal SS(j) applied to the $j^{th}$ pixel row, for example, the $i+2^{th}$ second gate signal SS(i+2). For example, as shown in FIG. 11, the start timing of the control signal CS(k) may be delayed for a certain time according to a charging slew rate within the range tp of a certain period from a timing at which the second gate signal SS(i) applied to the $i^{th}$ pixel row transitions to a low level. For example, an on-voltage period of the control signal CS(k) may be shorter than the charge sharing period CSP.

Although the display apparatus 10A includes one gate driver in the above embodiments, Embodiments are not limited thereto. For example, the display apparatus may include gate drivers.

Figure 12:
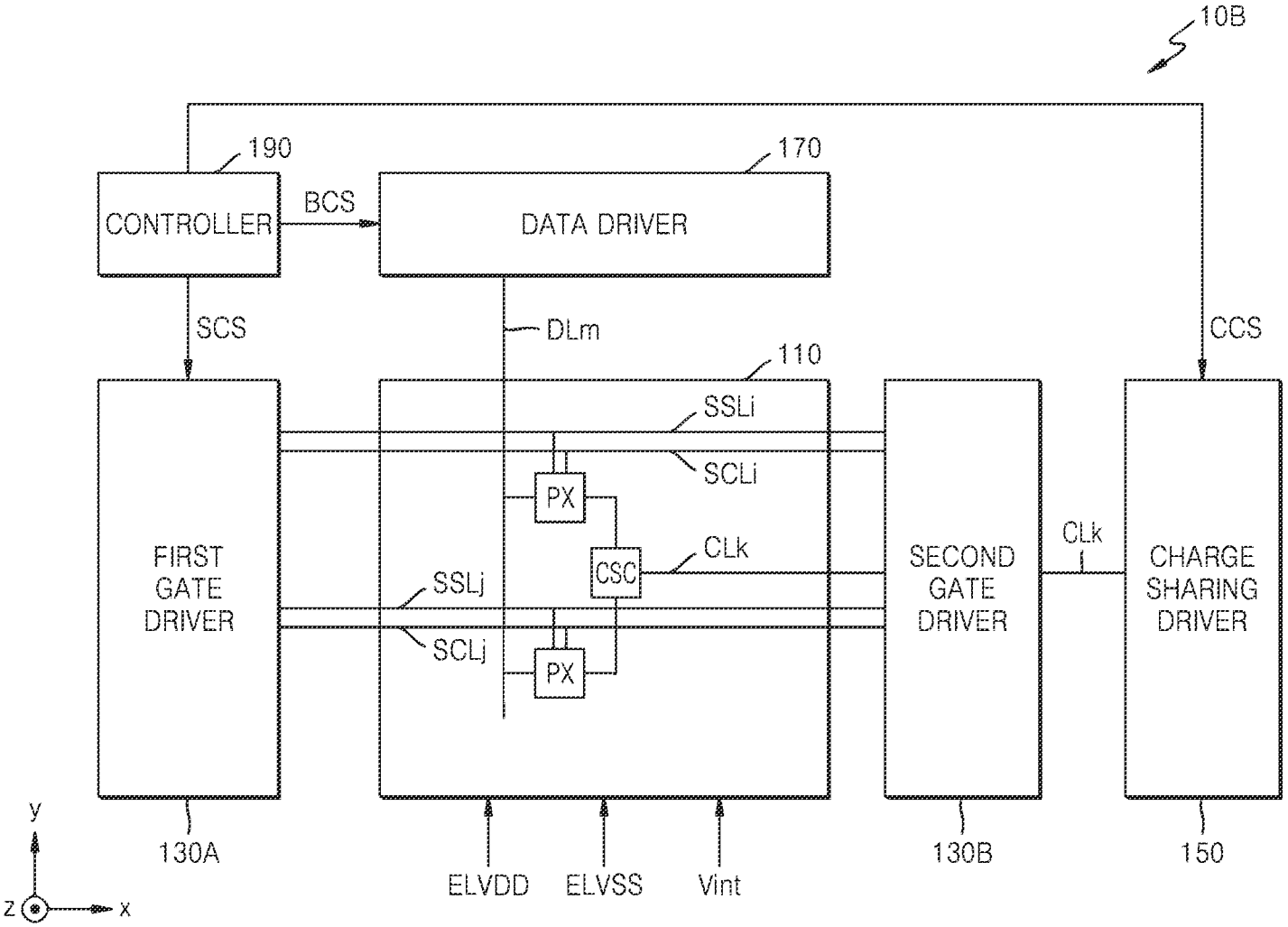
FIG. 12 is a schematic diagram illustrating a display apparatus according to an embodiment.
Figure 13:
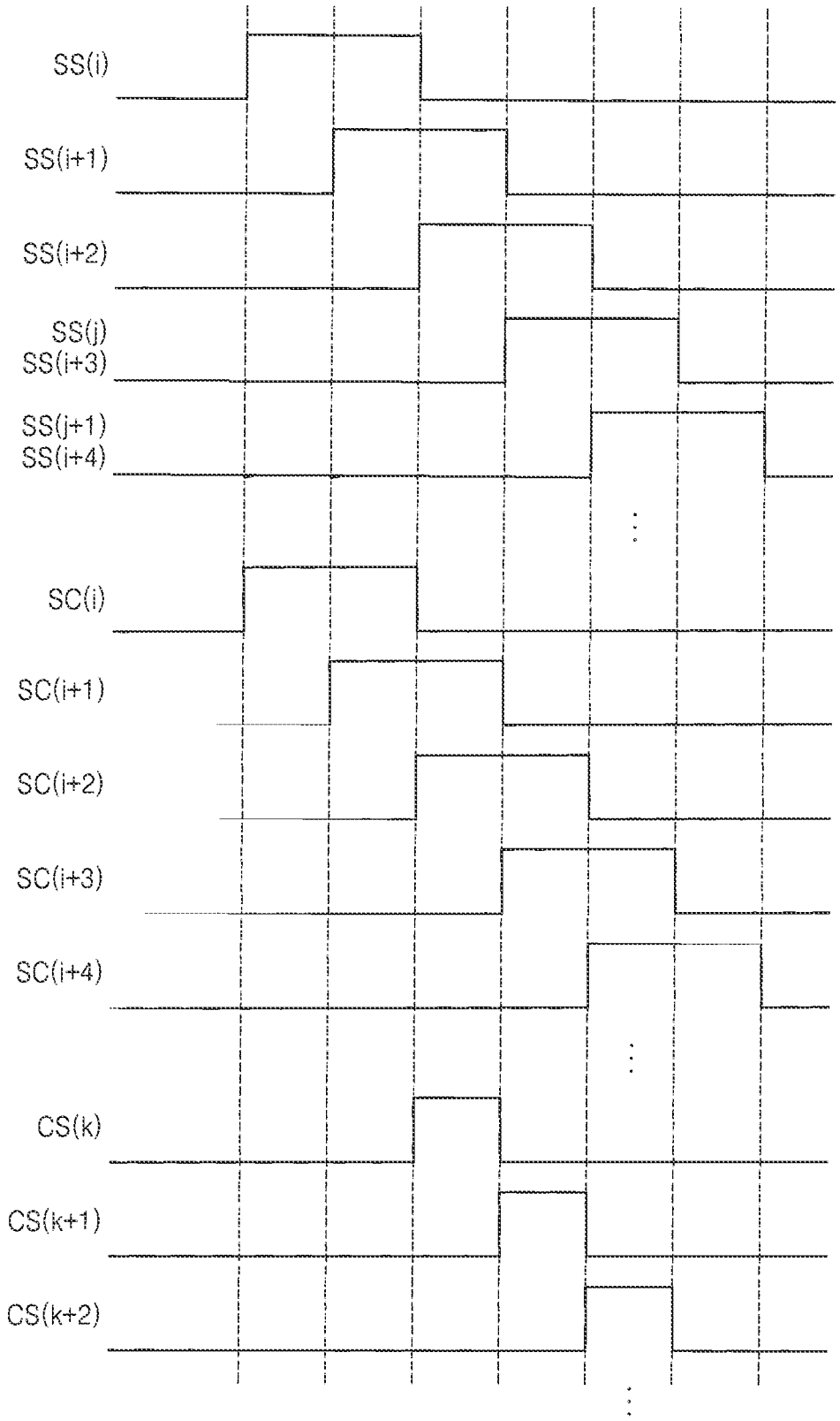
FIG. 13 is a schematic diagram illustrating signals for describing an operation of a charge sharing circuit of FIG. 12.
Figure 14:
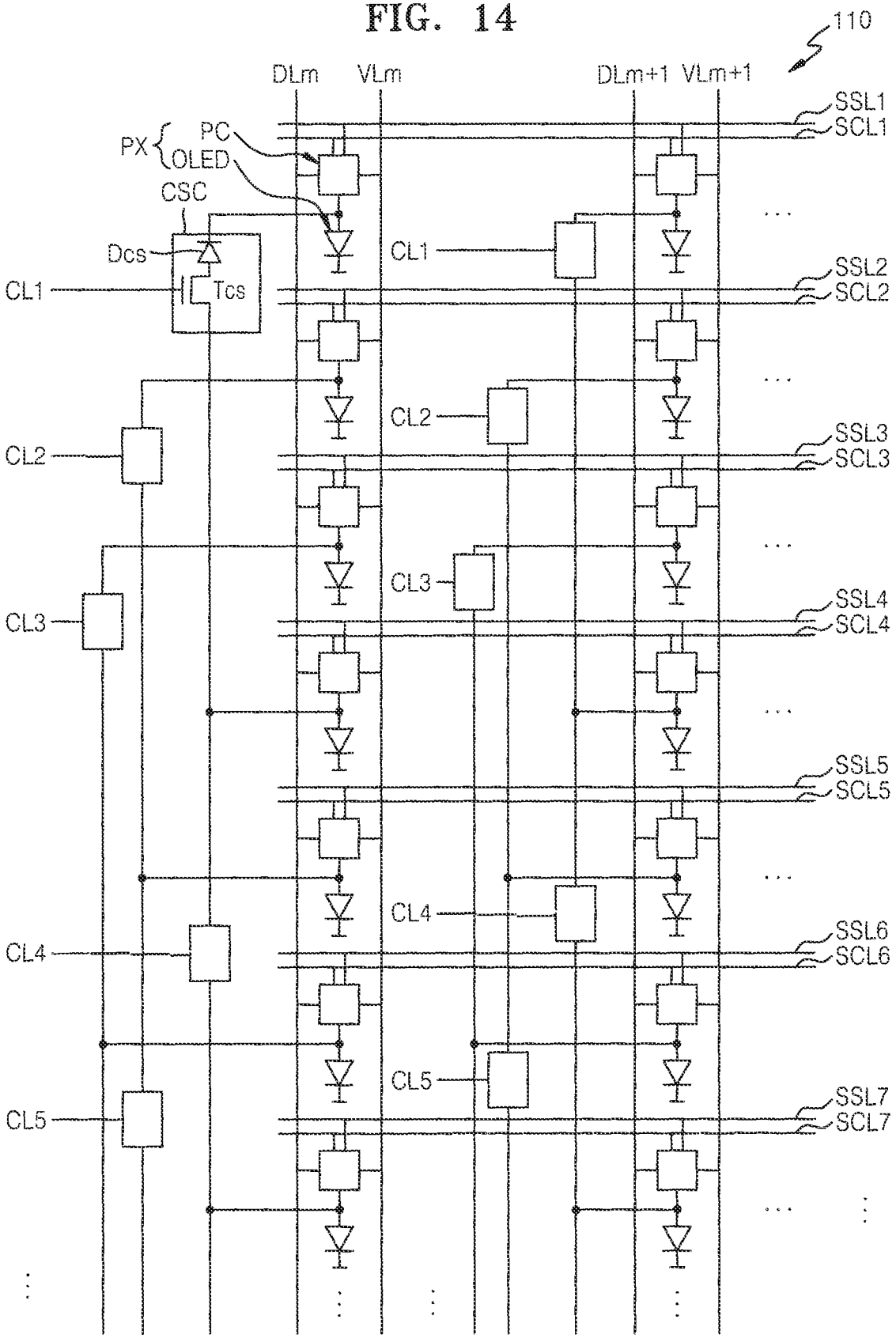
FIG. 14 is a schematic diagram illustrating a part of a pixel unit according to an embodiment.
Figure 15:
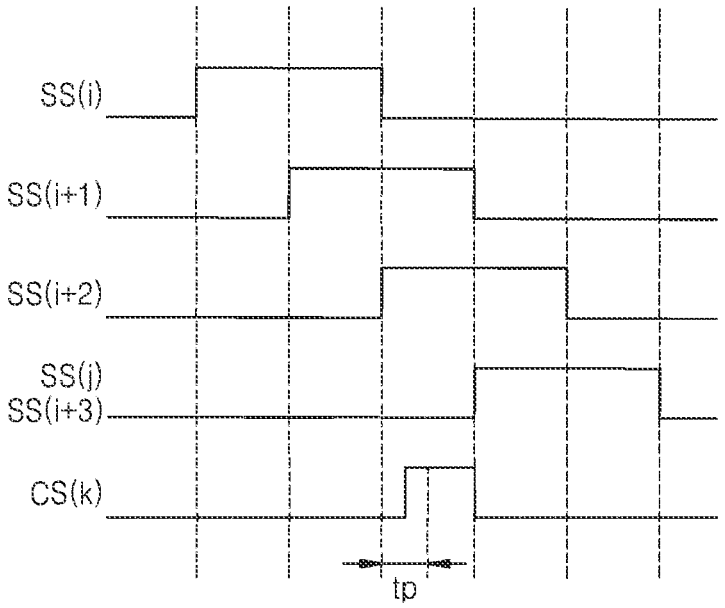
FIG. 15 is a schematic diagram illustrating timings of a gate signal and a control signal according to an embodiment.

FIG. 12 is a schematic diagram illustrating a display apparatus according to an embodiment. FIG. 13 is a schematic diagram illustrating signals for describing an operation of a charge sharing circuit of FIG. 12. FIG. 14 is a schematic diagram illustrating a part of a pixel unit according to an embodiment. FIG. 15 is a schematic diagram illustrating timings of a gate signal and a control signal according to an embodiment.

The following will focus on a difference from the above embodiments, and a redundant description will be omitted. For convenience of explanation, a pixel that receives current from a pixel electrode of a pixel of another pixel row is referred to as a first pixel, and a pixel that supplies current to a pixel electrode of a pixel of another pixel row is referred to as a second pixel.

Referring to FIG. 12, a display apparatus 10B according to an embodiment may include the pixel unit 110, a first gate driver 130A, a second gate driver 130B, the charge sharing driver 150, the data driver 170, and the controller 190. In the pixel unit 110, the pixels PX of FIG. 3 may be arranged. In the pixel unit 110, the first gate lines SCL and the second gate lines SSL connected to the pixels PX may be arranged.

The first gate driver 130A and the second gate driver 130B may be respectively provided on a left side and a right side of the pixel unit 110.

The first gate driver 130A may be connected to gate lines, and may sequentially supply the first gate signal SC and the second gate signal SS to the gate lines. The second gate driver 130B may be connected to gate lines, and may sequentially supply the first gate signal SC and the second gate signal SS to the gate lines. The first gate driver 130A and the second gate driver 130B may sequentially supply the first gate signal SC and the second gate signal SS to the gate lines simultaneously at the same timing. Accordingly, a voltage drop of a gate signal due to an increase in a distance from a gate driver in a large display apparatus may be prevented, and thus, a decrease in image quality due to a load deviation of the gate signal may be minimized (or prevented). Timings of on-voltage periods of the first gate signal SC and the second gate signal SS applied to the same row of the pixel unit 110 may be the same.

As shown in FIG. 13, the first gate driver 130A and the second gate driver 130B may sequentially output first gate signals SC(i), SC(i+1), SC(i+2), SC(i+3), SC(i+4), . . . and second gate signals SS(i), SS(i+1), SS(i+2), SS(i+3), SS(i+4), . . . . The first gate signals SC(i), SC(i+1), SC(i+2), SC(i+3), SC(i+4), . . . may have a pulse width (e.g., an on-voltage period) that is n times (where n is a natural number equal to or greater than 2) one horizontal period, and may adjacent first gate signals may overlap each other by n−1 times one horizontal period. The second gate signals SS(i), SS(i+1), SS(i+2), SS(i+3), SS(i+4), . . . may have a pulse width (e.g., an on-voltage period) that is n times (where n is a natural number equal to or greater than 2) one horizontal period, and adjacent second gate signals may overlap each other by n−1 times one horizontal period. For example, the first gate signals SC(i), SC(i+1), SC(i+2), SC(i+3), SC(i+4), may have a pulse width (e.g., an on-voltage period) of two horizontal periods 2H, and adjacent first gate signals may overlap each other by one horizontal period 1H. The second gate signals SS(i), SS(i+1), SS(i+2), SS(i+3), SS(i+4), . . . may have a pulse width (e.g., an on-voltage period) of two horizontal periods 2H, and adjacent second gate signals may overlap each other by one horizontal period 1H. Accordingly, an abnormal gate signal due to a short scan time in case that the display apparatus is driven may be prevented, and a decrease in image quality may be prevented (minimized).

The charge sharing driver 150 may be provided on a left side or a right side of the pixel unit 110. The charge sharing driver 150 may be connected to the control lines CL, and may sequentially supply the control signal CS to the control lines CL. The control lines CL may be connected to the charge sharing circuits CSC of the pixel unit 110. The control lines CL may be connected to a gate of the control transistor Tcs, and may connect a pixel electrode of a first pixel and a pixel electrode of a second pixel of different rows connected to the charge sharing circuit CSC due to the control signal CS.

In an embodiment, a pair of pixel rows connected by the charge sharing circuit CSC may be spaced apart from each other by three pixel rows. The pair of pixel rows may be an odd row and an even row that are spaced apart from each other by three pixel rows. For example, as shown in FIG. 12, the pixel PX connected to an $i^{th}$ first gate line SCLi and an $i^{th}$ second gate line SSLi connected to the first gate driver 130A and the second gate driver 130B and the pixel PX connected to a $j^{th}$ first gate line SCLj and a $j^{th}$ second gate line SSLj connected to the first gate driver 130A and the second gate driver 130B may be connected to the charge sharing circuit CSC. Here, j may be i+3, as shown in FIG. 13. FIG. 12 illustrates the pixel PX connected to a data line DLm of an $m^{th}$ pixel row.

The control signal CS output from the charge sharing driver 150 may be applied between second gate signals applied to a pair of pixel rows. For example, as shown in FIG. 13, the charge sharing driver 150 may apply a control signal CS(k) in the charge sharing period CSP between the $i^{th}$ second gate signal SS(i) and the $i+3^{th}$ second gate signal SS(i+3), and may apply a control signal CS(k+1) between the $i+1^{th}$ second gate signal SS(i+1) and the $i+4^{th}$ second gate signal SS(i+4). Control signals . . . , CS(k), CS(k+1), CS(k+2), . . . may be sequentially output from the charge sharing driver 150 without overlapping each other.

Referring to FIG. 14, the charge sharing circuit CSC may be provided between an odd row and an even row in each column, and the gate of the control transistor Tcs in the charge sharing circuit CSC may connect pixel electrodes of a pair of pixels connected to the charge sharing circuit CSC in response to the control signal CS applied to the control line CL. The control lines CL may be a gate control line separate from the first gate line SCL and the second gate line SSL.

For example, the control transistor Tcs in which the gate is connected to a first control line CL1 may connect a pixel electrode of the pixel PX of a first pixel row to a pixel electrode of the pixel PX of a fourth pixel row in case that a control signal is applied to the first control line CL1. The control transistor Tcs in which the gate is connected to a second control line CL2 may connect the pixel electrode of the pixel PX of a second pixel row to a pixel electrode of the pixel PX of a fifth pixel row in case that a control signal is applied to the second control line CL2. The control transistor Tcs in which the gate is connected to a third control line CL3 may connect a pixel electrode of the pixel PX of a third pixel row to a pixel electrode of the pixel PX of a sixth pixel row in case that a control signal is applied to the third control line CL3.

The control signal may be sequentially supplied from the first control line CL1 to a last control line. The control signal CS may be applied for a certain time within a period from a timing at which the pixel electrode of the first pixel starts to be charged to a timing before the pixel electrode of the second pixel starts to be discharged. In an embodiment, as shown in FIG. 13, the control signal CS may be applied for a period from an end timing of the second gate signal SS applied to the first pixel to a start timing of the second gate signal SS applied to the second pixel. In another example, as shown in FIG. 15, a start timing of the control signal CS may be adjusted within the range tp of a certain period from a start timing of the charge sharing period CSP. For example, the start timing of the control signal CS may be adjusted within the range tp of a certain period from an end timing of the second gate signal SS applied to the first pixel. An end timing of the control signal CS(k) may be a start timing of the second gate signal SS(j) applied to the $j^{th}$ pixel row, e.g., the $i+3^{th}$ second gate signal SS(i+3). A start timing of the control signal CS(k) may be delayed for a certain time according a charging slew rate within the range tp of a certain period from an end timing of the second gate signal SS(i) applied to the $i^{th}$ pixel row.

Figure 16:
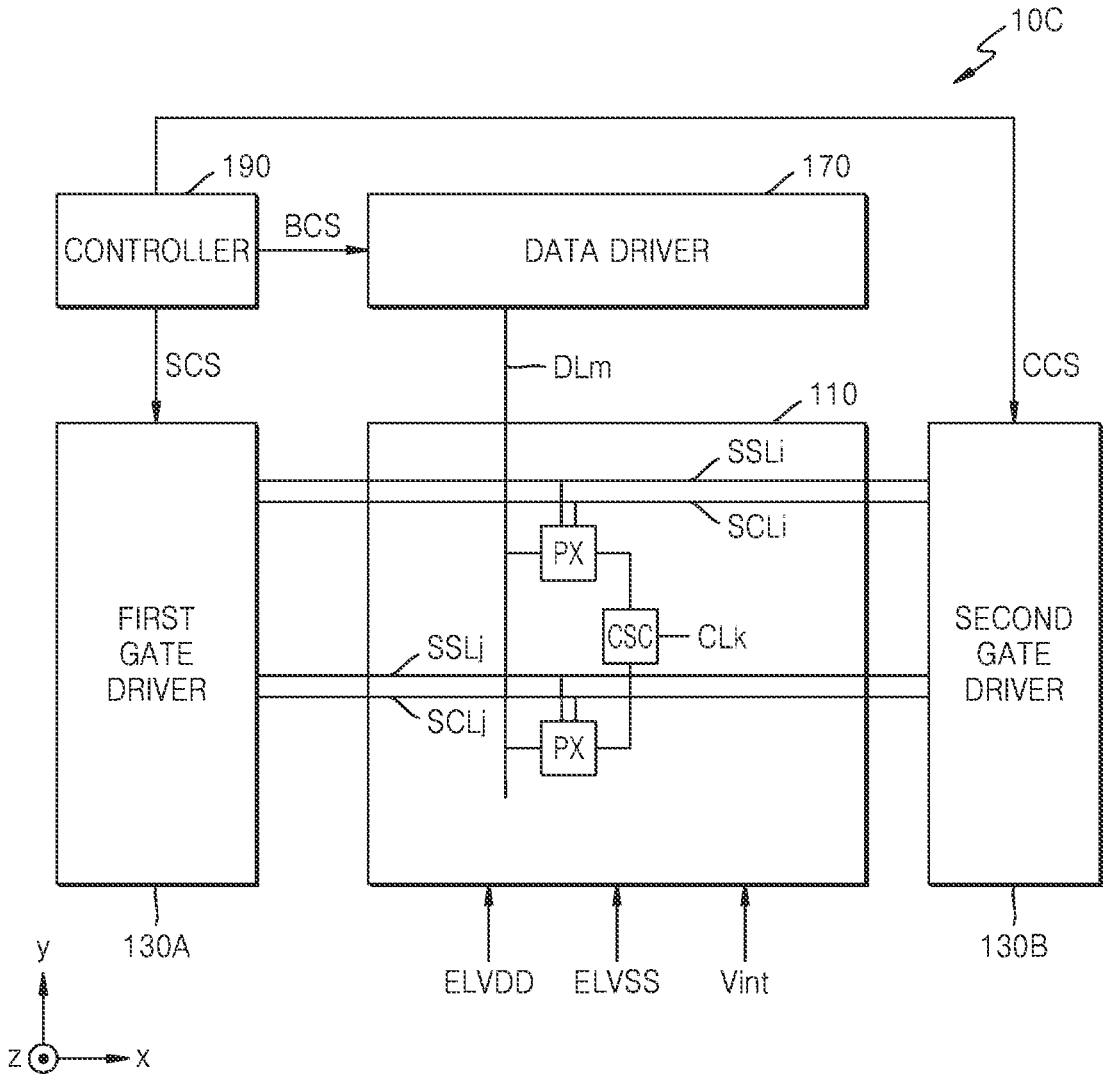
FIG. 16 is a schematic diagram illustrating a display apparatus according to an embodiment.
Figure 17:
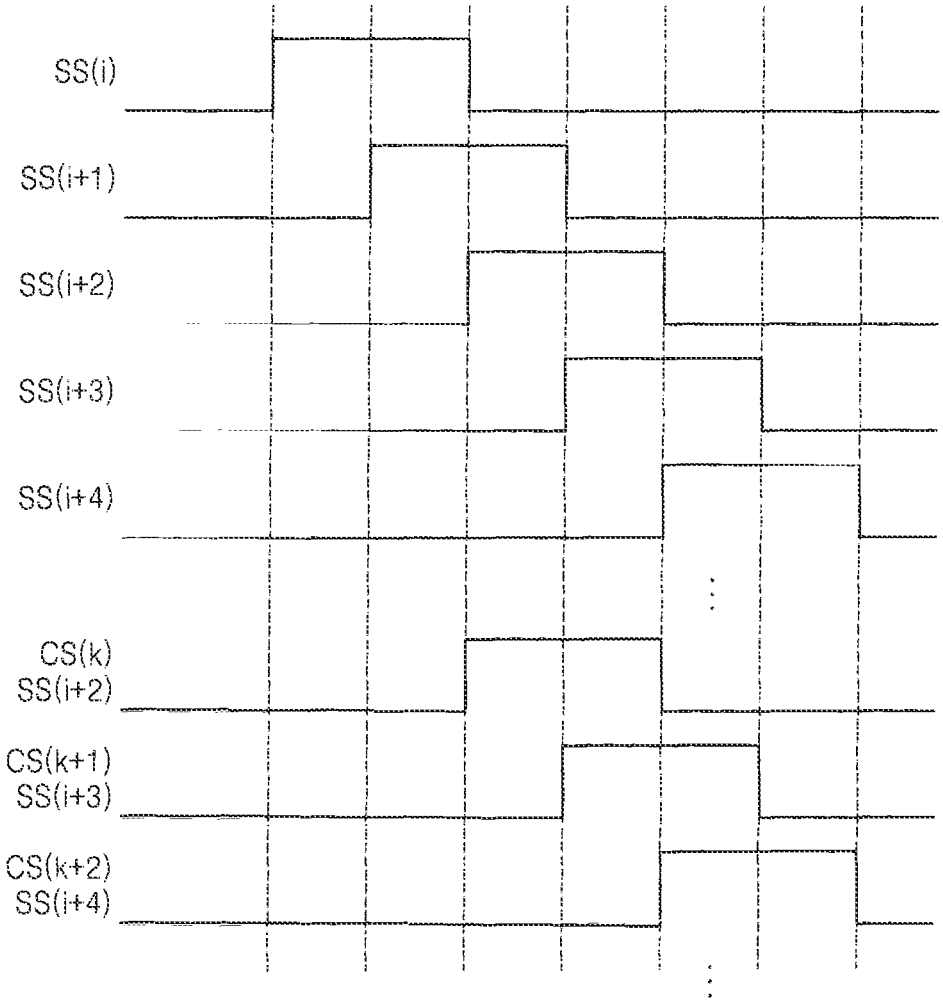
FIG. 17 is a schematic diagram illustrating timings of a gate signal and a control signal of FIG. 16.
Figure 18:
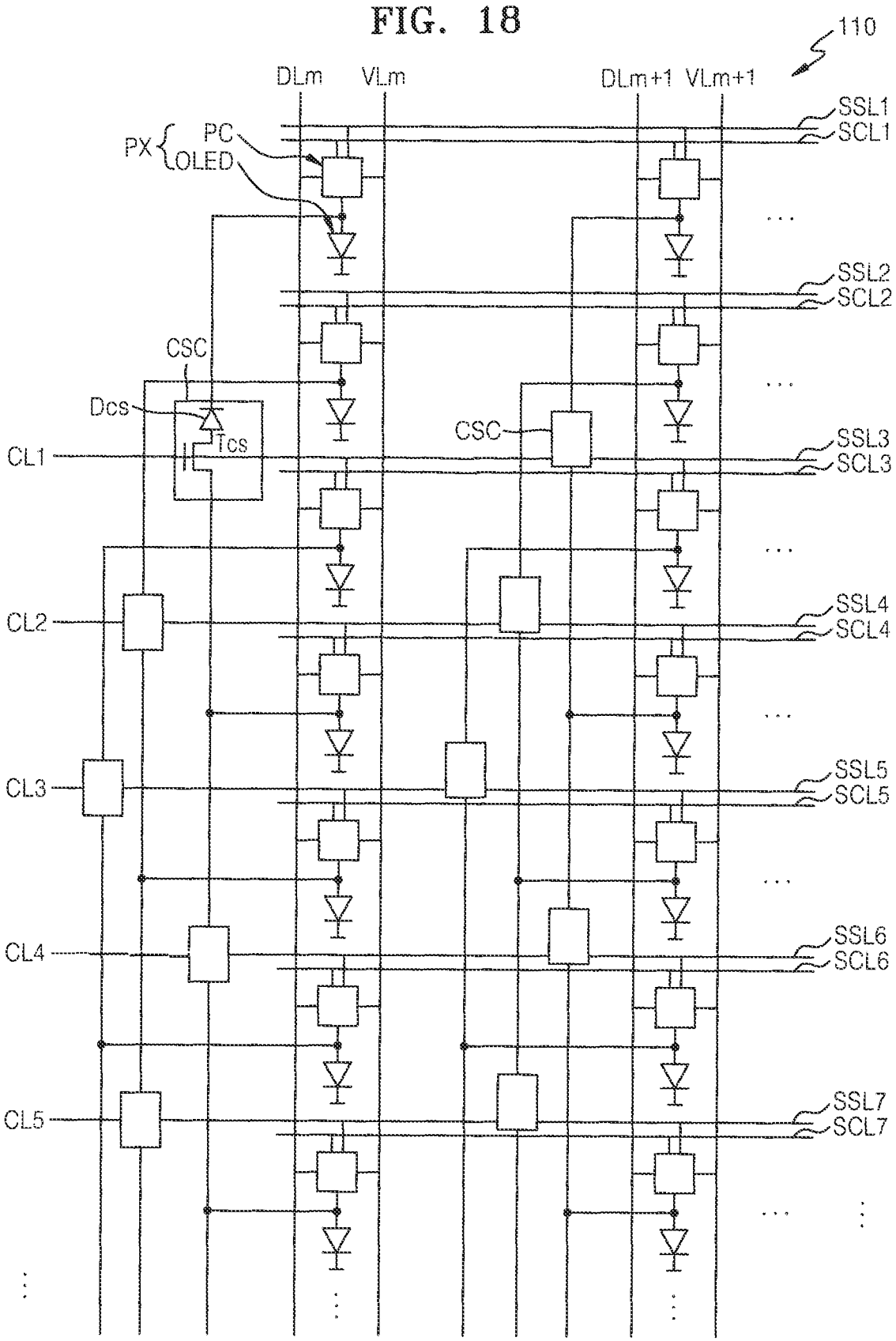
FIG. 18 is a schematic diagram illustrating a part of a pixel unit according to an embodiment.

FIG. 16 is a schematic diagram illustrating a display apparatus according to an embodiment. FIG. 17 is a schematic diagram illustrating timings of a gate signal and a control signal of FIG. 16. FIG. 18 is a schematic diagram illustrating a part of a pixel unit according to an embodiment.

As shown in FIG. 16, in a display apparatus 10C, the charge sharing driver 150 may be omitted, and as shown in FIG. 18, the control lines CL may be the second gate lines SSL connected to the first gate driver 130A and the second gate driver 130B.

A pair of pixels of a pair of pixel rows connected by the charge sharing circuit CSC may be spaced apart from each other by three pixel rows. The pair of pixel rows may be an odd row and an even row that are spaced apart from each other by three pixel rows.

For example, the charge sharing circuit CSC between a first pixel row and a fourth pixel row may include the control transistor Tcs in which a gate is applied to a second gate line SSL3 of a third pixel row, and the control transistor Tcs may be turned on by receiving a second gate signal as a control signal, to connect a pixel electrode of the pixel PX of the first pixel row to a pixel electrode of the pixel PX of the fourth pixel row. The charge sharing circuit CSC between a second pixel row and a fifth pixel row may include the control transistor Tcs in which the gate is applied to a second gate line SSL4 of the fourth pixel row, and the control transistor Tcs may be turned on by receiving a second gate signal as a control signal, to connect a pixel electrode of the pixel PX of the second pixel row to a pixel electrode of the pixel PX of the fifth pixel row. The charge sharing circuit CSC between a third pixel row and a sixth pixel row may include the control transistor Tcs in which the gate is connected to a second gate line SSL5 of the fifth pixel row, and the control transistor Tcs may be turned on by receiving a second gate signal as a control signal, to connect a pixel electrode of the pixel PX of the third pixel row to a pixel electrode of the pixel PX of the sixth pixel row.

As shown in FIG. 17, the control signal CS(k) may be an $i+2^{th}$ second gate signal SS(i+2) between an $i^{th}$ second gate signal SS(i) and an $i+3^{th}$ second gate signal SS(i+3). The control signal CS(k+1) may be an $i+3^{th}$ second gate signal SS(i+3) between an $i+1^{th}$ second gate signal SS(i+1) and an $i+4^{th}$ second gate signal SS(i+4), Adjacent control signals . . . , CS(k), CS(k+1), CS(k+2), . . . may partially overlap each other.

The control signal CS may not overlap the second gate signal SS of the first pixel, and may partially overlap the second gate signal SS of the second pixel. Because the pixel electrode of the second pixel is discharged in a period for which the control signal CS overlaps the second gate signal SS of the second pixel, a pixel electrode voltage of the first pixel may be greater than a pixel electrode voltage of the second pixel, and thus, the control diode Dcs may be reverse-biased to block a flow of current from the pixel electrode of the second pixel PXj to the pixel electrode of the first pixel PXi. The first pixel may refer to a pixel that receives current from a pixel electrode of a pixel of another pixel row, and the second pixel may refer to a pixel that supplies current to a pixel electrode of a pixel of another pixel row. A voltage change of a pixel electrode due to charge sharing between pixels in the embodiments of FIGS. 12 through 18 is the same as that described with reference to FIGS. 8 through 10, and thus, a redundant description will be omitted.

Figure 19:
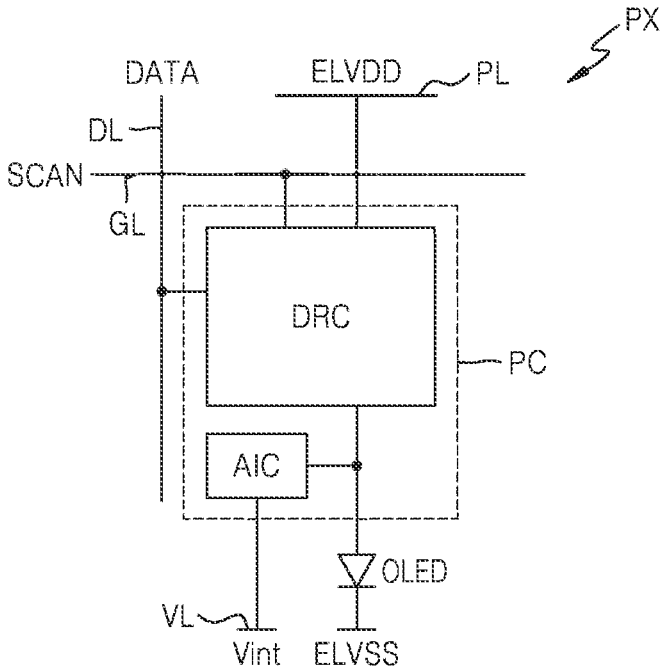
FIG. 19 is a schematic diagram illustrating a pixel according to an embodiment.

FIG. 19 is a schematic diagram illustrating a pixel according to an embodiment.

Referring to FIG. 19, the pixel PX may include the pixel circuit PC connected to the gate line GL and the data line DL, and the organic light-emitting diode OLED that is a display element connected to the pixel circuit PC. The pixel circuit PC may include a driver DRC and an initializer AIC. The organic light-emitting diode OLED may include a pixel electrode (e.g., a first electrode or an anode) and a counter electrode (e.g., a second electrode or a cathode), and the counter electrode may receive the second power supply voltage ELVSS. The organic light-emitting diode OLED may receive driving current from the driver DRC to emit light and display an image.

The driver DRC may be connected to a first power voltage line PL, and may be activated by a gate signal SCAN supplied from the gate line GL to generate and output driving current corresponding to a data signal DATA supplied from the data line DL. The organic light-emitting diode OLED may emit light with a luminance corresponding to the driving current transmitted from the driver DRC. The driver DRC may include transistors and a capacitor. The initializer AIC may be connected to the organic light-emitting diode OELD and the initialization line VL. The initializer AIC may initialize the organic light-emitting diode OLED by transmitting the initialization voltage Vint from the initialization line VL to the organic light-emitting diode OLED.

In an embodiment, the driver DRC may include the first transistor T1, the second transistor T2, and the capacitor Cst illustrated in FIG. 3, and the initializer AIC may include the third transistor T3 illustrated in FIG. 3. Embodiments are not limited thereto, and a configuration and a structure of a specific circuit device of each of the driver DRC and the initializer AIC may vary.

Figure 20:
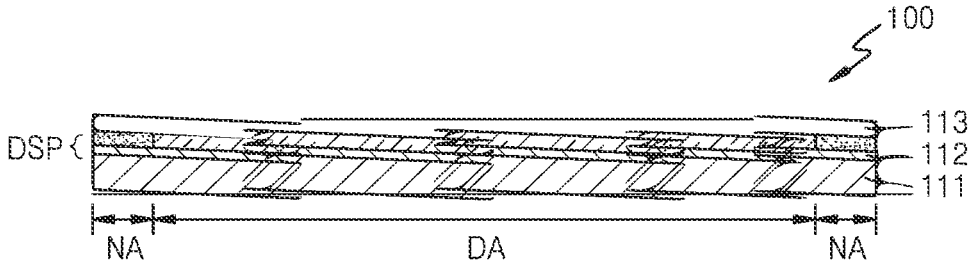
FIG. 20 is a schematic cross-sectional view illustrating a display apparatus according to an embodiment.
Figure 21:
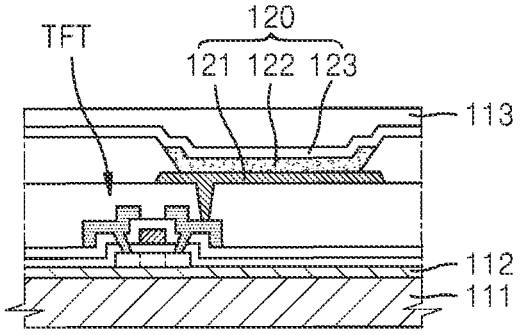
FIG. 21 is a schematic cross-sectional view illustrating a display area of FIG. 20.

FIG. 20 is a schematic cross-sectional view illustrating a display apparatus according to an embodiment. FIG. 21 is a schematic cross-sectional view illustrating a display area of FIG. 20.

Referring to FIGS. 20 and 21, a display apparatus may include a display panel 100. A cover window for protecting the display panel 100 may be further positioned on the display panel 100. The display panel 100 may include a display area DA where an image is displayed and a non-display area NDA positioned outside the display area to surround the display area DA.

The display panel 100 may include a substrate 111, and a display layer DSP on the substrate 111 and an encapsulation layer 113 on the display layer DSP. A buffer layer 112 and at least one insulating layer may be positioned in the display layer DSP. The display layer DSP may include a pixel circuit including a thin-film transistor TFT, and an organic light-emitting diode 120 that is a display element. The organic light-emitting diode 120 may include a pixel electrode 121, a counter electrode 123, and an emission layer 122 provided between the pixel electrode 121 and the counter electrode 123, and the pixel electrode 121 may be connected (e.g., electrically connected) to the pixel circuit including the thin-film transistor TFT.

The pixel unit 110 (see FIG. 1) may be positioned in the display area DA of the substrate 111, and driving circuits such as the gate driver 130 and the charge sharing driver 150 may be positioned in the non-display area NDA. For example, a part or all of the gate driver 130 may be formed (e.g., directly formed) in the non-display area NDA of the substrate 111 during a process of forming a transistor of the pixel circuit in the display area of the substrate 111 by using a gate-in-panel (GIP) method.

The data driver 170 and the controller 190 may be positioned on a flexible printed circuit board (FPCB) connected (e.g., electrically connected) to a pad positioned on a side of the substrate 111. In another example, the data driver 170 and the controller 190 may be positioned (e.g., directly positioned) on the substrate 111 by using a chip-on-glass (COG) or chip-on-plastic (COP) method.

The display layer DSP may be covered by the encapsulation layer 113. The encapsulation layer 113 may be a thin-film encapsulation layer or a sealing substrate. The thin-film encapsulation layer may include at least one inorganic encapsulation layer and at least one organic encapsulation layer. In an embodiment, the thin-film encapsulation layer may have a structure in which a first inorganic encapsulation layer, an organic encapsulation layer, and a second inorganic encapsulation layer are stacked.

In a display apparatus according to embodiments, because current that is inevitably discarded (or consumed) from a pixel is used to charge a pixel electrode of a pixel of another pixel row, power consumption may be reduced and the energy reduction policy may be followed. Also, in a display apparatus according to embodiments, because a slew rate is improved and early stabilization of an initialization voltage applied to a pixel electrode of a pixel is achieved, image quality may be improved.

Although an organic light-emitting display apparatus has been described as a display apparatus according to an embodiment, the display apparatus of the disclosure is not limited thereto. In another example, the display apparatus of the disclosure may be a display apparatus such as an inorganic light-emitting display apparatus (or an inorganic electroluminescence (EL) display apparatus) or a quantum dot light-emitting display apparatus.

A display apparatus according to embodiments may be implemented as an electronic device such as a smartphone, a mobile phone, a smart watch, a navigation device, a game console, a TV, a vehicle head unit, a notebook computer, a laptop computer, a tablet computer, a personal media player (PMP), or a personal digital assistant (PDA). Also, the electronic device may be a flexible device.

According to embodiments, because a pixel electrode is charged by sharing charges between pixels positioned in different pixel rows, power consumption may be reduced and a display apparatus with improved image quality may be implemented. However, the scope of the disclosure is not limited by these effects.

It should be understood that embodiments described herein should be considered in a descriptive sense only and not for purposes of limitation. Descriptions of features or aspects within each embodiment should typically be considered as available for other similar features or aspects in other embodiments. In case that one or more embodiments have been described with reference to the figures, it will be understood by one of ordinary skill in the art that various changes in form and details may be made therein without departing from the spirit and scope as defined by the following claims.

What is claimed is:

1. A display apparatus comprising:

a first pixel positioned in a first pixel row, the first pixel comprising a first light-emitting diode and a first initialization transistor connected between a pixel electrode of the first light-emitting diode and an initialization line;

a second pixel positioned in a second pixel row, the second pixel comprising a second light-emitting diode and a second initialization transistor connected between a pixel electrode of the second light-emitting diode and the initialization line;

a charge sharing circuit comprising a control transistor connected between the pixel electrode of the first light-emitting diode and the pixel electrode of the second light-emitting diode;

a first gate line positioned in the first pixel row, the first gate line connected to a gate of the first initialization transistor;

a second gate line positioned in the second pixel row, the second gate line connected to a gate of the second initialization transistor; and a control line connected to a gate of the control transistor.

2. The display apparatus of claim 1, wherein the charge sharing circuit further comprises a control diode connected between the control transistor and the pixel electrode of the first light-emitting diode.

3. The display apparatus of claim 1, wherein a control signal applied to the control line is applied later than a gate signal applied to the first gate line and earlier than a gate signal applied to the second gate line, and a pixel electrode voltage of the first light-emitting diode increases from an initialization voltage applied from the initialization line to a first intermediate voltage at a first slew rate during a first period of a period for which the control signal is applied, and increases from the first intermediate voltage to a light-emitting voltage at a second slew rate during a second period subsequent to the first period.

4. The display apparatus of claim 1, wherein a control signal applied to the control line is applied later than a gate signal applied to the first gate line and earlier than a gate signal applied to the second gate line, and a pixel electrode voltage of the second light-emitting diode decreases from a light-emitting voltage to a second intermediate voltage at a third slew rate during a period of a period for which the control signal is applied, and decreases from the second intermediate voltage to an initialization voltage applied from the initialization line at a fourth slew rate during a period of a period for which the gate signal is applied to the second gate line.

5. The display apparatus of claim 1, wherein the second pixel row is spaced apart from the first pixel row by two pixel rows, a gate signal applied to the second gate line is applied later than a gate signal applied to the first gate line by a certain time, and a control signal applied to the control line is positioned between the gate signal applied to the first gate line and the gate signal applied to the second gate line.

6. The display apparatus of claim 5, wherein the control signal is applied after the gate signal applied to the first gate line by a certain time.

7. The display apparatus of claim 1, further comprising a third pixel positioned in a third pixel row between the first pixel row and the second pixel row, the third pixel comprising a third light-emitting diode and a third initialization transistor connected between a pixel electrode of the third light-emitting diode and the initialization line, wherein the third pixel row is spaced apart from each of the first pixel row and the second pixel row by one pixel row, and the control line is a third gate line connected to a gate of the third initialization transistor.

8. The display apparatus of claim 1, wherein the second pixel row is spaced apart from the first pixel row by three pixel rows, a gate signal applied to the second gate line is applied later than a gate signal applied to the first gate line by a certain time, and a control signal applied to the control line is positioned between the gate signal applied to the first gate line and the gate signal applied to the second gate line.

9. The display apparatus of claim 8, wherein the control signal is applied later than the gate signal applied to the first gate line by a certain time.

10. The display apparatus of claim 1, further comprising a third pixel positioned in a third pixel row between the first pixel row and the second pixel row, the third pixel comprising a third light-emitting diode and a third initialization transistor connected between a pixel electrode of the third light-emitting diode and the initialization line, wherein the third pixel row is spaced apart from the first pixel row by two pixel rows, and is spaced apart from the second pixel row by one pixel row, and the control line is a third gate line connected to a gate of the third initialization transistor.

11. The display apparatus of claim 10, wherein a gate signal applied to the third gate line is subsequent to a gate signal applied to the first gate line, and partially overlaps a gate signal applied to the second gate line.

12. A display apparatus comprising:

a pixel unit comprising a plurality of pixels; and a gate driver that applies a gate signal to the plurality of pixels, wherein the pixel unit comprises:

a first pixel positioned in a first pixel row, the first pixel comprising a first light-emitting diode and a first initialization transistor, the first initialization transistor being connected between a pixel electrode of the first light-emitting diode and an initialization line and controlled by a first gate signal;

a second pixel positioned in a second pixel row, the second pixel comprising a second light-emitting diode and a second initialization transistor, the second initialization transistor being connected between a pixel electrode of the second light-emitting diode and the initialization line and controlled by a second gate signal that is applied later than the first gate signal by a certain time; and a charge sharing circuit comprising a control transistor connected between the pixel electrode of the first light-emitting diode and the pixel electrode of the second light-emitting diode, and controlled by a control signal applied between the first gate signal and the second gate signal.

13. The display apparatus of claim 12, wherein the charge sharing circuit further comprises a control diode forward-biased from the pixel electrode of the second light-emitting diode to the pixel electrode of the first light-emitting diode.

14. The display apparatus of claim 12, wherein a pixel electrode voltage of the first light-emitting diode increases from an initialization voltage applied from the initialization line to a first intermediate voltage at a first slew rate during a first period of a period for which the control signal is applied, and increases from the first intermediate voltage to a light-emitting voltage at a second slew rate during a second period subsequent to the first period.

15. The display apparatus of claim 12, wherein a pixel electrode voltage of the second light-emitting diode decreases from a light-emitting voltage to a second intermediate voltage at a third slew rate during a period of a period for which the control signal is applied, and decreases from the second intermediate voltage to an initialization voltage applied from the initialization line during a period of a period for which a gate signal is applied to a gate of the second initialization transistor.

16. The display apparatus of claim 12, wherein the control signal is applied later than the first gate signal by a certain time.

17. The display apparatus of claim 12, wherein the pixel unit further comprises a third pixel positioned in a third pixel row, the third pixel comprising a third light-emitting diode and a third initialization transistor, the third initialization transistor being connected between a pixel electrode of the third light-emitting diode and the initialization line, the second pixel row is spaced apart from the first pixel row by two pixel rows, the third pixel row is spaced apart from each of the first pixel row and the second pixel row by one pixel row, and the control signal is a gate signal applied to a gate line connected to a gate of the third initialization transistor.

18. The display apparatus of claim 12, wherein the pixel unit further comprises a third pixel positioned in a third pixel row, the third pixel comprising a third light-emitting diode and a third initialization transistor, the third initialization transistor being connected between a pixel electrode of the third light-emitting diode and the initialization line, the second pixel row is spaced apart from the first pixel row by three pixel rows, the third pixel row is spaced apart from the first pixel row by two pixel rows, and is spaced apart from the second pixel row by one pixel row, and the control signal is a third gate signal applied to a gate line connected to a gate of the third initialization transistor.

19. The display apparatus of claim 18, wherein the third gate signal is subsequent to the first gate signal, and partially overlaps the second gate signal.

20. The display apparatus of claim 12, wherein the gate driver comprises a first gate driver positioned on a left side of the pixel unit, and a second gate driver positioned on a right side of the pixel unit, and the first pixel row and the second pixel row are an odd row and an even row spaced apart from each other by three pixel rows.

* * * * *